US010731517B2

(12) United States Patent
Liskar et al.

(10) Patent No.: US 10,731,517 B2
(45) **Date of Patent: *Aug. 4, 2020**

(54) VALVETRAIN WITH ROCKER ARM HOUSING MAGNETIC LATCH

(71) Applicant: Eaton Intelligent Power Limited, Dublin (IE)

(72) Inventors: Petr Liskar, Prague (CZ); Dale Arden Stretch, Novi, MI (US); James Edward McCarthy, Kalamazoo, MI (US); Nicholas Peter Gillette, Ceresco, MI (US); Andrei Dan Radulescu, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/877,145

(22) Filed: Jan. 22, 2018

(65) Prior Publication Data

US 2018/0195419 A1 Jul. 12, 2018

Related U.S. Application Data

(63) Continuation-in-part of application No. 15/503,458, filed on Feb. 13, 2017, now Pat. No. 10,180,089, (Continued)

(51) Int. Cl.
*F01L 1/18* (2006.01)
*F01L 1/20* (2006.01)
(Continued)

(52) U.S. Cl.
CPC ..... *F01L 1/20* (2013.01); *F01L 1/053* (2013.01); *F01L 1/182* (2013.01); *F01L 1/185* (2013.01); *F01L 1/2405* (2013.01); *F01L 13/0005* (2013.01); *H01F 7/02* (2013.01); *H01F 7/081* (2013.01); *F01L 13/0036* (2013.01); *F01L 2001/0537* (2013.01);
(Continued)

(58) Field of Classification Search
CPC ..... F01L 1/185; F01L 13/0005; F01L 1/20; F01L 13/0036; F01L 2001/186; F01L 2001/467; F01L 2013/101
USPC ..... 123/90.11, 90.16, 90.39, 90.44
See application file for complete search history.

(56) References Cited

U.S. PATENT DOCUMENTS 3,040,217 A 6/1959 Conrad
4,203,397 A 5/1980 Soeters, Jr.
(Continued)

FOREIGN PATENT DOCUMENTS

DE 10310220 A1 9/2004
EP 2050933 A1 4/2009

*Primary Examiner* — Ching Chang
(74) *Attorney, Agent, or Firm* — Paul V. Keller

(57) ABSTRACT

A valvetrain includes a rocker arm assembly having a rocker arm and an electromagnetic latch assembly. A magnet of the latch assembly is housed within a chamber formed by the rocker arm. The chamber may be a retrofit hydraulic chamber. The magnet may be an electromagnet or a permanent magnet. A flux shifting bi-stable latch provides a sufficiently compact design. Isolation of the magnet within the rocker arm chamber may provide protection from metal particles carried by oil in an operating environment for the rocker arm assembly.

25 Claims, 25 Drawing Sheets

Related U.S. Application Data which is a continuation-in-part of application No. PCT/US2015/045759, filed on Aug. 15, 2015.

(60) Provisional application No. 62/613,376, filed on Jan. 3, 2018, provisional application No. 62/488,747, filed on Apr. 22, 2017, provisional application No. 62/449,174, filed on Jan. 23, 2017, provisional application No. 62/195,766, filed on Jul. 22, 2015, provisional application No. 62/155,069, filed on Apr. 30, 2015, provisional application No. 62/140,096, filed on Mar. 30, 2015.

(51) Int. Cl.

| | |
|---|---|
| ***F01L 1/053*** | (2006.01) |
| ***H01F 7/02*** | (2006.01) |
| ***H01F 7/08*** | (2006.01) |
| ***F01L 13/00*** | (2006.01) |
| ***F01L 1/24*** | (2006.01) |
| *H01F 7/06* | (2006.01) |
| *H01F 7/16* | (2006.01) |
| *F01L 1/46* | (2006.01) |

(52) U.S. Cl.

CPC ... *F01L 2001/186* (2013.01); *F01L 2001/467* (2013.01); *F01L 2013/101* (2013.01); *F01L 2103/00* (2013.01); *F01L 2105/00* (2013.01); *H01F 7/064* (2013.01); *H01F 7/1615* (2013.01)

(56) References Cited

U.S. PATENT DOCUMENTS

| | | | | |
|---|---|---|---|---|
| 5,544,626 | A | 8/1996 | Diggs et al. | |
| 5,896,076 | A | 4/1999 | van Namen | |
| 6,318,318 | B1 | 11/2001 | Jahr | |
| 6,901,894 | B2 * | 6/2005 | Haas | F01L 1/182 123/90.39 |
| 10,180,089 | B2 * | 1/2019 | Liskar | F01L 13/0005 123/90.39 |
| 10,358,951 | B2 * | 7/2019 | Liskar | F01L 1/181 123/90.39 |
| 10,371,016 | B2 * | 8/2019 | McCarthy, Jr. | F01L 1/18 123/90.39 |
| 2008/0006232 | A1 | 1/2008 | Gregor et al. | |

* cited by examiner

VALVETRAIN WITH ROCKER ARM HOUSING MAGNETIC LATCH

PRIORITY

The present application claims priority from U.S. Provisional Patent Application No. 62/140,096 filed Mar. 30, 2015, U.S. Provisional Patent Application No. 62/155,069 filed Apr. 30, 2015, U.S. Provisional Patent Application No. 62/195,766 filed Jul. 22, 2015, PCT Application PCT/US15/45759, filed Aug. 15, 2015, U.S. Provisional Patent Application No. 62/449,174, filed Jan. 23, 2017, U.S. patent application Ser. No. 15/503,458, filed Feb. 13, 2017, U.S. Provisional Patent Application No. 62/488,747, filed Apr. 22, 2017, and U.S. Provisional Patent Application No. 62/613,376, filed Jan. 3, 2018, which applications are incorporated by reference in their entireties.

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost. The oil demands of these hydraulic feeds may approach the limits of existing supply systems.

SUMMARY

Complexity and demands for oil in some valvetrain systems can be reduced by replacing hydraulically latched rocker arm assemblies with electrically latched rocker arm assemblies. Rocker arm assemblies operate in an environment that contains engine oil in which small particles of metal may be suspended. Electromagnetic latch assemblies include electromagnets and often permanent magnets as well. These magnets may draw metal particles from the oil to locations where they could interfere with latch operation.

The present teachings relate to a valvetrain for an internal combustion engine of a type that has a combustion chamber and a moveable valve having a seat formed in the combustion chamber. The valvetrain includes a camshaft, an electromagnetic latch assembly, and a rocker arm assembly. The rocker arm assembly may include a cam follower configured to engage a cam mounted on the camshaft as the camshaft rotates. The electromagnetic latch assembly may include a latch pin translatable between a first position and a second position and a coil. One of the first and second latch pin positions may provide a configuration in which the rocker arm assembly is operative to actuate the moveable valve in response to rotation of the camshaft to produce a first valve lift profile. The other of the first and second latch pin positions may provide a configuration in which the rocker arm assembly is operative to actuate the valve in response to rotation of the camshaft to produce a second valve lift profile, which is distinct from the first valve lift profile, or may deactivate the valve.

According to some aspects of the present teachings, the rocker arm assembly includes a rocker arm that forms a chamber that houses a magnet that is part of the electromagnetic latch assembly. The rocker arm is a load-bearing structure and the chamber is formed within the load bearing structure. In some of these teaching the rocker arm is formed from a single piece of metal that may be cast or stamped. The magnet remains within the chamber even as the latch pin translates between the first position and the second position. In some of these teachings, the chamber is sealed to exclude metal particles suspended in oil, which may be dispersed in the environment surrounding the rocker arm. Housing the magnet within the rocker arm may protect the latch from metal particles in the oil while conserving space.

Some of the present teachings relate to retrofitting a hydraulically latched rocker arm assembly with an electromagnetic latch assembly. The rocker arm may have been designed and put into production for use with a hydraulically actuated latch. Rocker arms for commercial applications are typically manufactured using customized casting and stamping equipment requiring a large capital investment. In some of the present teachings, the rocker arm is one that was designed to house a hydraulically actuated latch and includes a hydraulic chamber, which is the chamber within which the magnet is installed. It has been found that components of a hydraulic latch assembly, which may include a coil of sufficient size to actuate a rocker arm latch, can be retrofit into a rocker arm chamber that was designed for a hydraulically actuated latch.

In some of these teachings, the magnet is a coil that provides an electromagnet for the electromagnetic latch assembly. In some of these teachings, the magnet is a permanent magnet. In some of these teachings, the permanent magnet is mounted to remain stationary with respect to the rocker arm. Fixing the permanent magnet to the rocker arm means not fixing the permanent magnet to the latch pin. Taking the weight of the permanent magnet off the latch pin may increase actuation speed and allow the use of a smaller coil.

In some of these teachings, both a coil and a permanent magnet are installed within the chamber. In some of these teachings, the permanent magnet is installed within the coil. In some of these teachings, the electromagnetic latch assembly includes two permanent magnets arranged with confronting polarities and with a pole piece of magnetically susceptible material between them. In some of these teachings, the magnetically susceptible material is a low coercivity ferromagnetic material. The magnets and the pole piece are held in fixed positions relative to the rocker arm and arranged about an opening through which the latch pin translates. In some of these teaching, the pole piece bounds the opening. The permanent magnets may also bound the opening. In some of these teachings, the pole piece bounds the opening more narrowly than the permanent magnets, whereby the latch pin contacts the pole piece but does not contact either of the magnets. In this configuration, the pole piece helps secure the latch pin against rocking while the permanent magnets are relieved of stress.

In some aspects of the present teachings, the electromagnetic latch assembly provides the latch pin with positional stability independently from the coil when the latch pin is in the first position and when the latch pin is in the second position. This dual positional stability enables the latch to retain both latched and unlatched states without reliance on the coil. In these teachings, the coil does not need to be powered or operative on the latch pin except during latch pin actuation, which may be limited to times at which the rocker arm is in a cam-on-base-circle position. This feature facilitates implementation of an electromagnetic latch assembly all or part of which is mounted to a rocker arm that has a range of motion. If the electromagnetic latch assembly requires power transferred to a rocker arm-mounted coil, the power transfer need only be effective when the rocker arm is in the cam-on-base-circle position. If an actuator including the coil is mounted to a part distinct from the rocker arm, the actuator need only be operative on the latch pin when the rocker arm is in the cam-on-base-circle position.

In some of these teachings, a permanent magnet contributes to the positional stability of the latch pin both when the latch pin is in the first position and when the latch pin is in the second position. According to some further aspects of these teachings, the electromagnetic latch assembly is structured to operate through a magnetic circuit-shifting mechanism. In some of these teachings, absent any magnetic fields generated by the electromagnet or other external sources, when the latch pin is in the first position, an operative portion of the magnetic flux from the permanent magnet follows a first magnetic circuit and when the latch pin is in the second position, an operative portion of the magnetic flux from the permanent magnet follows a second magnetic circuit distinct from the first magnetic circuit. The coil may be operative to redirect the permanent magnet's flux away or toward one or the other of these magnetic circuits and thereby cause the latch pin to actuate. In some of these teachings redirecting the magnetic flux includes reversing the magnetic polarity in a low coercivity ferromagnetic element forming part of both the first and second magnetic circuits. An electromagnetic latch assembly structured to be operable through a magnetic circuit-shifting mechanism may be smaller than one that is not so structured and may be operative with a smaller coil.

In some of these teaching, the coil encircles a volume within which a portion of the latch pin comprising low coercivity ferromagnetic material translates and the electromagnetic latch assembly comprises one or more sections of low coercivity ferromagnetic material outside the volume encircled by the coil. The one or more sections of low coercivity ferromagnetic material outside the volume encircled by the coil may form a capped can around the coil. Both the first and the second magnetic circuits pass through the latch pin portion formed of low coercivity ferromagnetic material. In some of these teachings, the first magnetic circuit passes around the outside of the coil via the one or more sections of low coercivity ferromagnetic material while the second magnetic circuit does not pass around the outside of the coil. This characteristic of the second magnetic circuit reduces magnetic flux leakage and increases the force with which the permanent magnet holds the latch pin in the second position.

In some of these teachings, the electromagnetic latch assembly includes a second permanent magnet distal from the first and fulfilling a complimentary role. The electromagnetic latch assembly may provide two distinct magnetic circuits for the second permanent magnet, one or the other of which is the path taken by an operative portion of the magnet flux from the second permanent magnet depending on the whether the latch pin is in the first position or the second position. The path taken when the latch pin is in the second position may pass around the outside of the coil via the one or more sections of low coercivity ferromagnetic material. The path taken when the latch pin is in the first position may be a shorter path that does not pass around the outside of the coil. One or the other of the permanent magnets may then provide a high holding force depending on whether the latch pin is in the first or second positions. In some of these teachings, both permanent magnets contribute to the positional stability of the latch pin in both the first and the second latch pin positions. In some of these teachings, the two magnets are arranged with confronting polarities. In some of these teachings, the two magnets are located at distal ends of the volume encircled by the coil. In some of these teachings, the permanent magnets are annular in shape and polarized along the directions of the axes. These structures may be conducive to providing a compact and efficient design. Whether the latch pin is in the first position or the second position, the latch pin is held by magnetic flux following a short flux path, resulting in low flux leakage and allowing the permanent magnets to be made smaller.

A shell surrounding a coil housed within the rocker arm may have an opening through which the latch pin extends. In accordance with some aspects of the present teachings, the latch pin has a non-circular profile where it passes through that opening. The shape of the opening cooperates with the latch pin profile to restrict rotation of the latch pin. This structure provides an anti-rotation function and facilitates smooth operation of the latch pin, particularly when the latch pin is supported within the coil. In some of these teachings, the shell is part of a magnetic circuit that makes a magnet of the electromagnetic latch assembly operative on the latch pin.

In some of the present teaching, the internal combustion engine has circuitry operable to energize the coil with a current in either a first direction or a second direction, which is the reverse of the first direction. A latch having dual positional stability may require the coil current to be in one direction for latching and the opposite direction for unlatching. The coil powered with current in the first direction may be operative to actuate the latch pin from the first position to the second position. The coil powered with current in the second direction may be operative to actuate the latch pin from the second position to the first position. In some others of these teachings, the electromagnetic latch assembly include two coils, one for latching and the other for unlatching. The two coils may have windings in opposite directions. Employing two coils may allow for the control circuitry to be more robust. Employing only one coil may provide the most compact design.

In some of the present teachings, a coil housed in a rocker arm is installed through an opening at the back of the rocker arm. The back of the rocker arm is an end of the rocker arm opposite an opening out of which the latch pin extends. In some of these teachings, a circuit powering the coil includes emerges from the back of the rocker arm and runs to the side of the rocker arm. The circuit may include an electrical connection made at the side of the rocker arm. The movement of the rocker arm may be constrained to directions in a plane parallel to the side of the rocker arm. A pivot axis for the rocker arm may also be located on the side of the rocker arm. Making connections to the coil through the back of the rocker arm avoids creating additional openings to the chamber, while an electrical connection may be more reliable if made at the side of the rocker arm. In some of these teachings, a conductor forming a part of this circuit runs along the side of the rocker arm while being held by a contact frame that is supported within an opening at the back of the rocker arm. This structure allows all or part of the contact frame support to be provided for by the opening or the parts installed within the opening at the back of the rocker arm. In some of these teachings, the contact frame is further supported by a fitting against the side of the rocker arm. In some of these teachings, the fitting is or is an extension of a contact pin that forms for an electrical connection to the rocker arm that is made at the side of the rocker arm. The contact pin may be piloted in the rocker arm.

In some of these teaching, a coil housed in a rocker arm and installed through an opening at the back of the rocker arm is wound about a bobbin that provides tie-offs for the coil wires and the tie-offs are positioned to provide connections to the coil at the back of the rocker arm at locations that are displaced toward the upper side of the rocker arm. The upper side of the rocker arm is the side facing the cam. This bobbin structure has been found to facilitate packaging in engines where there is little space between the back of the rocker arm and a valve cover.

In some of these teaching, a coil housed in a rocker arm and installed through an opening at the back of the rocker arm is wound about a bobbin with tie-off pins for the coil wires and a portion of each tie-off pin emerges from the back of the rocker arm and extends away from the coil axis. This structure is another way to facilitate packaging in engines where there is little space between the back of the rocker arm and the valve cover. These tie-off pin shapes affect assembly of the valvetrain. In some of these teaching, manufacturing is simplified by a method in which the coil wire is first wound about the bobbin and the wire ends connected to the tie-off pins, then a coil can cap is placed on the end of the bobbin, then the coil with the can cap attached is placed in the can, and then the can with the coil is installed in the chamber formed by the rocker arm.

Some aspects of the present teachings relate to a method of manufacturing an internal combustion engine in which a rocker arm designed for use with a hydraulic latch is fit with an electromagnetic latch assembly. The rocker arm may have a hydraulic chamber. According to the method, a portion of the electromagnetic latch assembly is fit into the hydraulic chamber. In some of these teachings, a coil of the electromagnetic latch assembly is fit into the hydraulic chamber. In some of these teachings, a permanent magnet operative to stabilize a latch pin in both the first and second positions is installed within the hydraulic chamber.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

DETAILED DESCRIPTION

Figure 1:
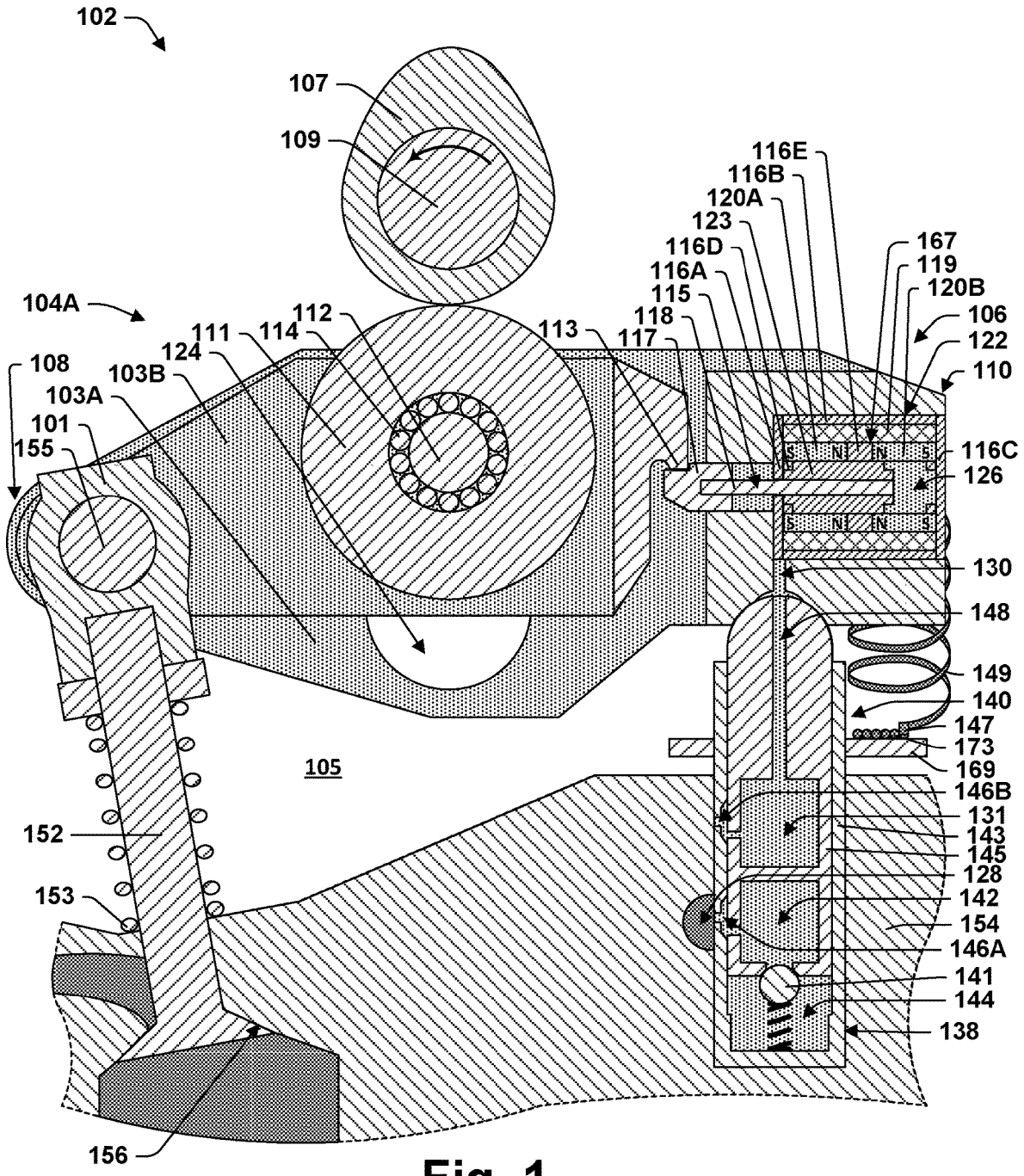
FIG. 1 is a cross-sectional side view of a portion of an internal combustion with a valvetrain according to some aspects of the present teachings, the valvetrain including a rocker arm assembly in a latching configuration and a cam on base circle.

In the drawings, some reference characters consist of a number with a letter suffix. In this description and the claims that follow, a reference character consisting of that same number without a letter suffix is equivalent to a listing of all reference characters used in the drawings and consisting of that same number with a letter suffix. For example, "rocker arm 103" is the same as "rocker arm 103A, 103B, 103C, 103D, 103E, 103F".

Figure 3:
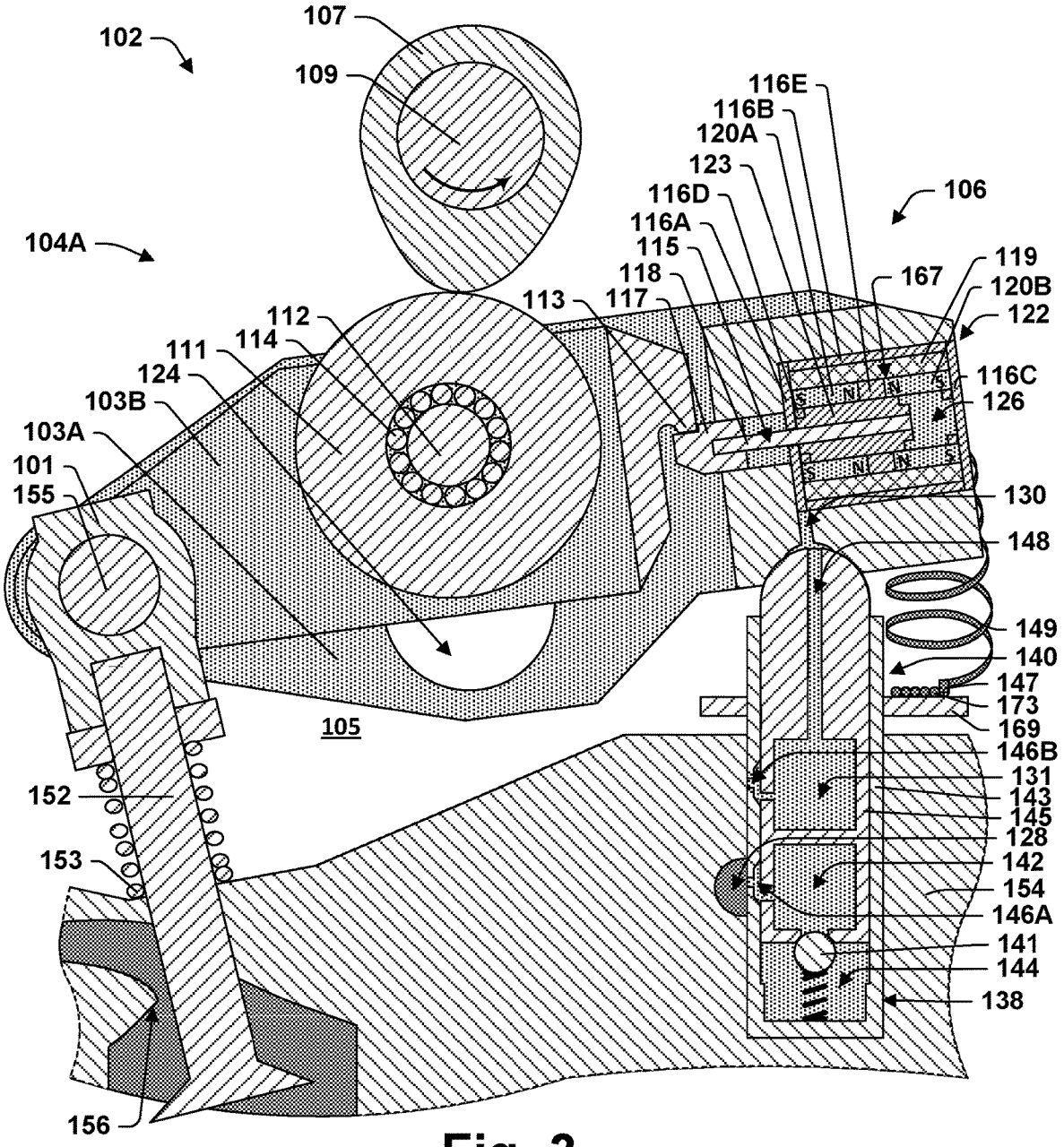
FIG. 3 provides the view of FIG. 1 but with the cam risen off base circle.
Figure 4:
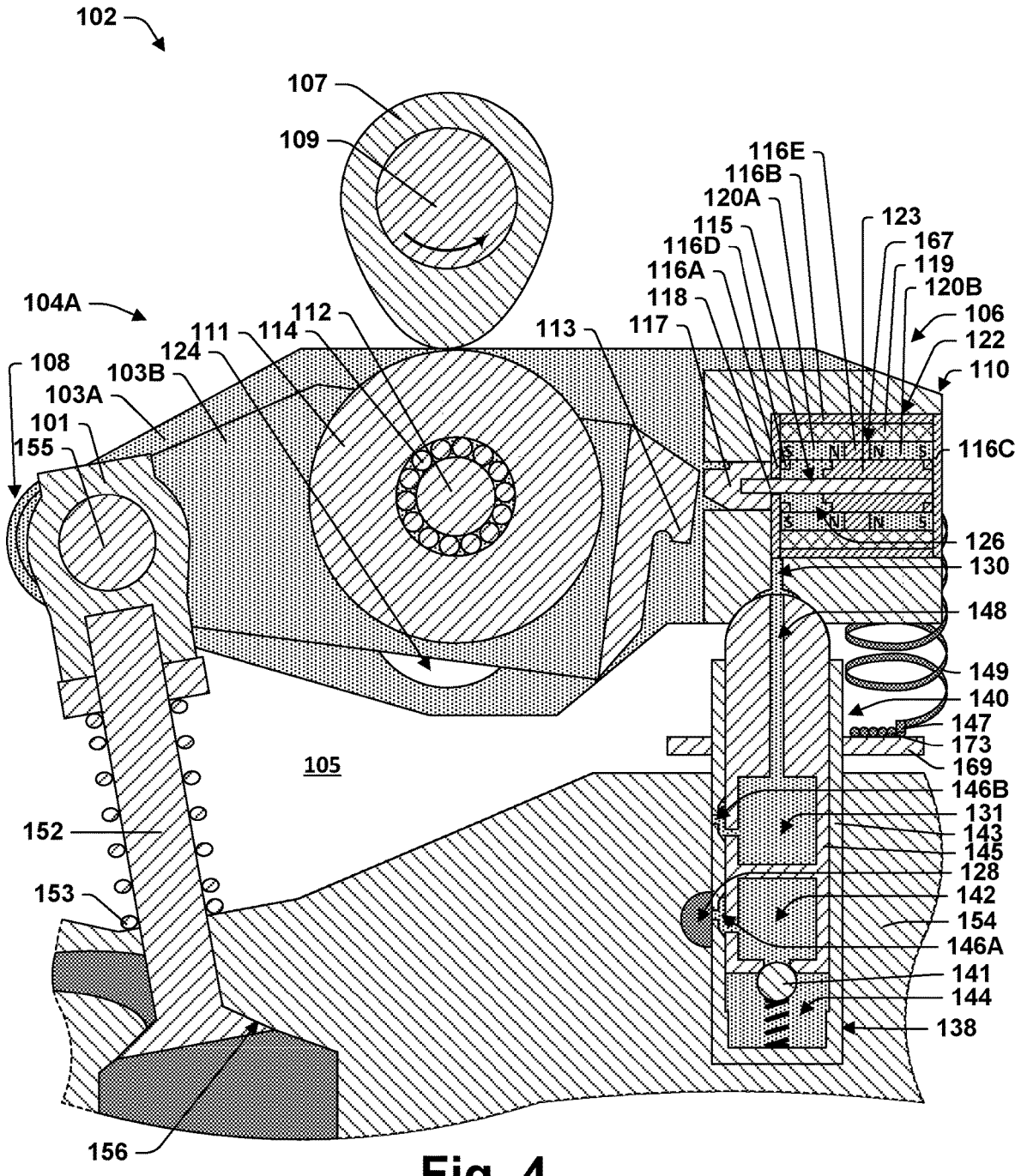
FIG. 4 provides the view of FIG. 2 but with the cam risen off base circle.
Figure 5:
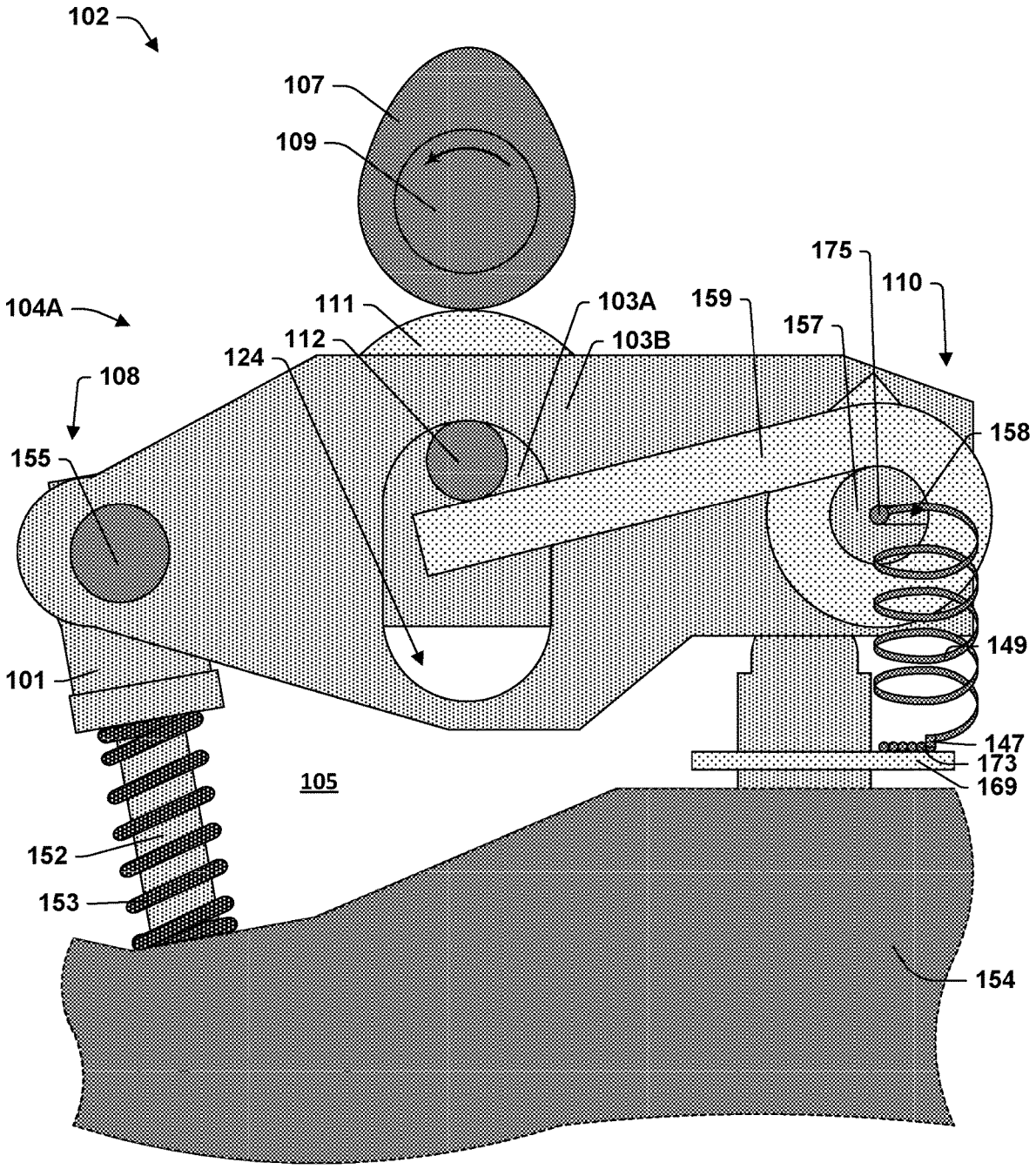
FIG. 5 provides a side view corresponding to the cross-sectional view of FIG. 1.

FIGS. 1-5 illustrate an internal combustion engine 102 including a valvetrain 104A according to some aspects of the present teachings. The views of FIGS. 1-4 are cutaway side views. FIG. 5 is a non-cutaway side view corresponding to FIG. 1. Valvetrain 104A includes a rocker arm assembly 106, a poppet valve 152, a cam shaft 109 on which is mounted a cam 107, and a pivot 140, which is a hydraulic lash adjuster. Rocker arm assembly 106 includes an outer arm 103A, an inner arm 103B, and an electromagnetic latch assembly 122. Electromagnetic latch assembly 122 includes coil 119 and latch pin 115. Outer arm 103A and inner arm 103B are selectively engaged by latch pin 115. Hydraulic lash adjuster 140 sits within a bore 138 formed in cylinder head 154 and provides a fulcrum for rocker arm assembly 106. Poppet valve 152 has a seat 156 within cylinder head 154.

Rocker arm assembly 106 may be held in place by contact with hydraulic lash adjuster 140, cam 107, and poppet valve 152. Cam follower 111 is configured to engage and follow cam 107 as camshaft 109 rotates. Cam follower 111 may be rotatably mounted to inner arm 103B through bearings 114 and axle 112. Rocker arm assembly 106 may include cam followers mounted to both inner arm 103B and outer arm 103A. Cam follower 111 is a roller follower. Another type of cam follower, such as a slider, may be used instead.

Outer arm 103A may be pivotally coupled to inner arm 103B through an axle 155. Axle 155 may also support an elephant's foot 101 through which rocker arm assembly 106 acts on valve 152. Axle 155 may be mounted on bearings or may be rigidly coupled to one of inner arm 103B, outer arm 103A, and elephant's foot 101. As shown in FIG. 5, a torsion spring 159, or a pair thereof, may be mounted to outer arm 103A on spring posts 157. Torsion springs 159 may act upwardly on axle 112 to create torque between inner arm 103B and outer arm 103A about axle 155 and bias cam follower 111 against cam 107. Openings 124 may be formed in outer arm 103A to allow axle 112 to pass through it and move freely up and down.

Figure 2:
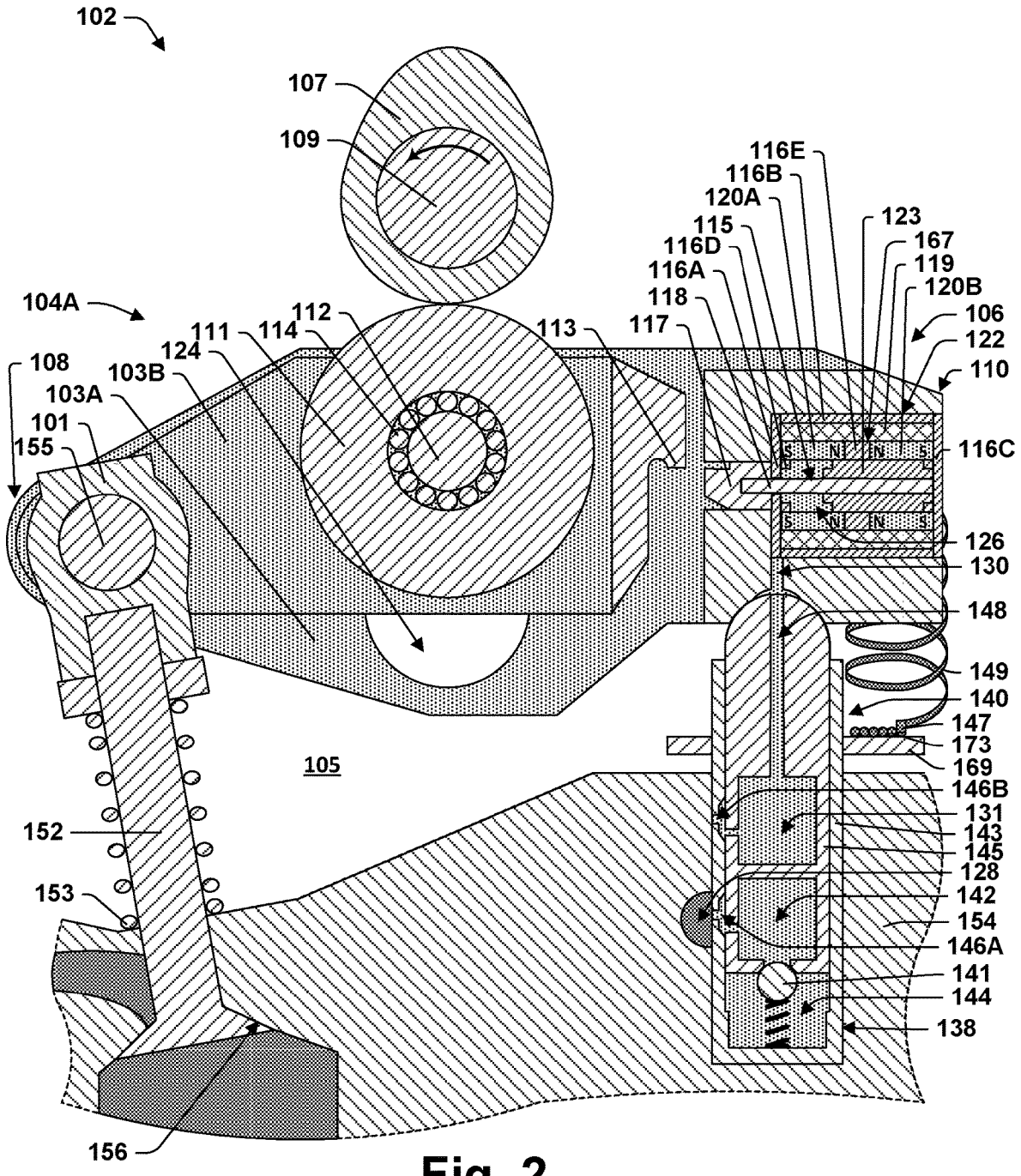
FIG. 2 provides the view of FIG. 1 but with the rocker arm assembly in a non-latching configuration.

FIG. 1 illustrates internal combustion engine 102 with cam 107 on base circle and latch pin 115 extended. This may be described an engaging position for latch pin 115 or an engaging configuration for rocker arm assembly 106. FIG. 2 shows the result if cam 107 is rotated off base circle while latch pin 115 is in the engaging position. Initially head 117 of latch pin 115 engages lip 113 of inner arm 103B. The force of cam 107 on cam follower 111 may then cause both inner arm 103B and outer arm 103A to pivot together on hydraulic lash adjuster 140, bearing down on valve 152 and compressing valve spring 153. Valve 152 may be lifted off its seat 156 with a valve lift profile determined by the shape of cam 107. The valve lift profile is the shape of a plot showing the height by which valve 152 is lifted of its seat 156 as a function of angular position of cam shaft 109. In the engaging configuration, cam shaft 109 may do work on rocker arm assembly 106 as cam 107 rises off base circle. Much of the resulting energy may be taken up by valve spring 153 and returned to cam shaft 109 as cam 107 descend back toward base circle.

Electromagnetic latch assembly 122 may be operated to retract latch pin 115. FIG. 3 illustrates internal combustion engine 102 with cam 107 on base circle and latch pin 115 retracted. This may be described as a non-engaging position for latch pin 115 or a non-engaging configuration for rocker arm assembly 106. FIG. 4 shows the result if cam 107 is rotated off base circle while latch pin 115 is in the non-engaging position. In this configuration, the downward force on cam follower 111 applied by cam 107 as it rises off base circle may be distributed between valve 152 and torsion springs 159. Torsions springs 159 may be tuned relative to valve spring 153 such that torsion springs 159 yield in the unlatched configuration while valve spring 153 does not. Torsion springs 159 wind and inner arm 103B descends while outer arm 103A remains in place. As a result, valve 152 may remain on its seat 156 even as cam 107 rises off base circle. In this configuration, cam shaft 109 still does work on rocker arm assembly 106 as cam 107 rises of base circle. But in this case, most of the resulting energy is taken up by torsions springs 159, which act as lost motion springs.

Hydraulic lash adjuster 140 may be replaced by a static pivot or another type of lash adjuster. Hydraulic lash adjuster 140 may include an inner sleeve 145 and an outer sleeve 143. Lash adjustment may be implemented using a hydraulic chamber 144 that is configured to vary in volume as hydraulic lash adjuster 140 extends or contracts through relative motion of inner sleeve 145 and outer sleeve 143. A supply port 146A may allow a reservoir chamber 142 to be filled from an oil gallery 128 in cylinder block 154. The fluid may be engine oil, which may be supplied at a pressure of about 2 atm. When cam 107 is on base circle, this pressure may be sufficient to open check valve 141, which admits oil into hydraulic chamber 144. The oil may fill hydraulic chamber 144, extending hydraulic lash adjuster 140 until there is no lash between cam 107 and roller follower 111. As cam 107 rises off base circle, hydraulic lash adjuster 140 may be compressed, pressure in hydraulic chamber 144 may rise, and check valve 141 may consequently close.

In accordance with some aspects of the present teachings, rocker arm assembly 106 may have been originally designed for use with a hydraulically latching rocker arm assembly. Accordingly a second supply port 146B may be formed in hydraulic lash adjuster 140 and communicate with a second reservoir chamber 131 in hydraulic lash adjuster 154. Cylinder head 154 may not include any provision for supplying oil to second supply port 146B. Second reservoir chamber 131 may be isolated from any substantial flow of hydraulic fluid in cylinder head 154. Reservoir chamber 131 and any hydraulic passages communicating therewith may be essentially non-functional in engine 102.

Valvetrain 104 is an end pivot overhead cam (OHC) type valvetrain. The present teaching are applicable to other types of valvetrains including, for example, an overhead valve (OHV) valvetrains, which may include a rocker arm assembly that is latched. As used in the present disclosure, the term "rocker arm assembly" may refer to any assembly of components that is structured and positioned to actuate valve 152 in response to rotation of a cam shaft 109. Rocker arm assembly 106 is a cylinder deactivating rocker arm. But some of the present teaching are also applicable to switching rocker arms and other types of rocker arm assemblies. In some of these teachings, a rocker arm is a unitary metal piece. Alternatively, a rocker arm may include multiple parts that are rigidly joined.

In accordance with some aspects of the present teachings, components of electromagnetic latch assembly 122 are mounted within a chamber 126 formed in rocker arm 103A of rocker arm assembly 106. Electromagnetic latch assembly 122 includes coil 119, permanent magnet 120A, and permanent magnet 120B, each of which is rigidly mounted to rocker arm 103A. These parts may be rigidly mounted to rocker arm 103A by being rigidly mounted to other parts that are themselves rigidly mounted to rocker arm 103A. Electromagnetic latch assembly 122 further includes latch pin 115 and low coercivity ferromagnetic pieces 116A, 116B, 116C, 116D, and 116E.

Latch pin 115 includes latch pin body 118, latch head 117, and a low coercivity ferromagnetic portion 123. Low coercivity ferromagnetic portion 123 may be part of latch pin body 118 or may be a separate component such as an annular structure fitting around latch pin body 118. Latch pin body 118 may be paramagnetic. Low coercivity ferromagnetic portion 123 provides a low reluctance pathway for magnetic circuits passing through latch pin 115 and may facilitate the application of magnetic forces to latch pin 115.

Low coercivity ferromagnetic pieces 116 may be described as pole pieces in that they are operative within electromagnetic latch assembly 122 to guide magnetic flux from the poles of permanent magnets 120. Low coercivity ferromagnetic pieces 116A, 116B, and 116C are located outside coil 119 and may form a shell around it. Low coercivity ferromagnetic pieces 116D may provide stepped edges in magnetic circuits formed by electromagnetic latch assembly 122. Low coercivity ferromagnetic portion 123 of latch pin 115 may be shaped to mate with these edges. During actuation, magnetic flux may cross an air gap between one of these stepped edge and latch pin 115, in which case the stepped edge may be operative to increase the magnetic forces through which latch pin 115 is actuated.

Coil 119 comprises a large number of wire loops that wrap around a volume 167. Permanent magnets 120 are positioned within volume 167 and are held in fixed positions within volume 167. Low coercivity ferromagnetic pieces 116D and 116E may also be positioned within volume 167. Permanent magnet 120A and permanent magnet 120B are arranged with confronting polarities. Low coercivity ferromagnetic piece 116E is positioned between the confronting poles and provides a pole piece for both magnets 120. Permanent magnets 120A and 120B are located at distal ends of volume 167. Permanent magnets 120 may be annular in shape and polarized in a direction parallel to that in which latch pin 115 translates. This may be along a central axis for coil 119.

Electromagnetic latch assembly 122 provides both extended and retracted positions in which latch pin 115 is stable. As a consequence, either the latched or unlatched configuration can be reliably maintained without coil 119 being powered. Positional stability refers to the tendency of latch pin 115 to remain in and return to a particular position. Stability is provided by restorative forces that act against small perturbations of latch pin 115 from a stable position. In electromagnetic latch assembly 122, stabilizing forces are provided by permanent magnets 120. Alternatively or in addition, one or more springs may be positioned to provide positional stability. Springs may also be used to bias latch pin 115 out of a stable position, which may be useful for increasing actuation speed.

Figure 6:
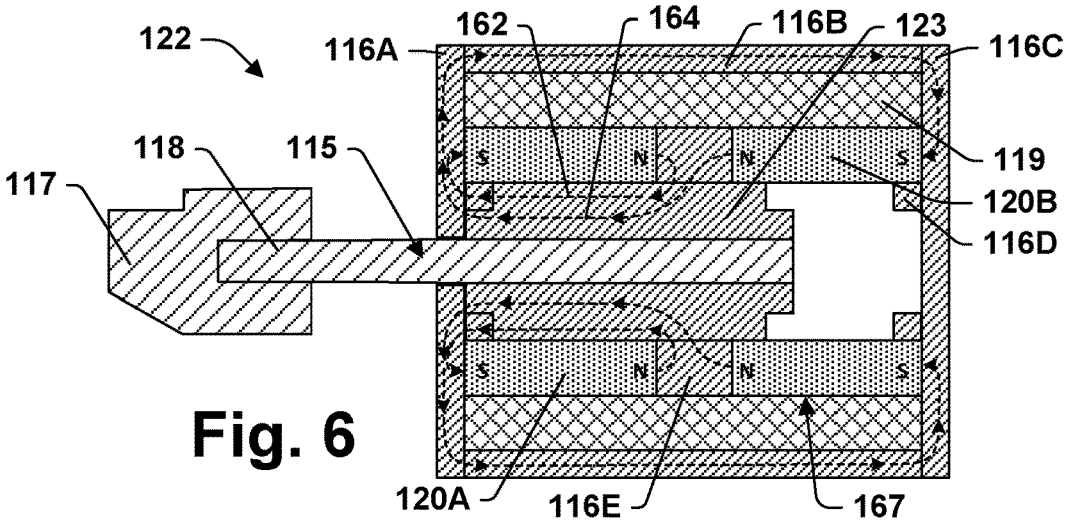
FIG. 6 is a cross-section side view of an electromagnetic latch assembly according to some aspects of the present teachings with the latch pin in an extended position.
Figure 8:
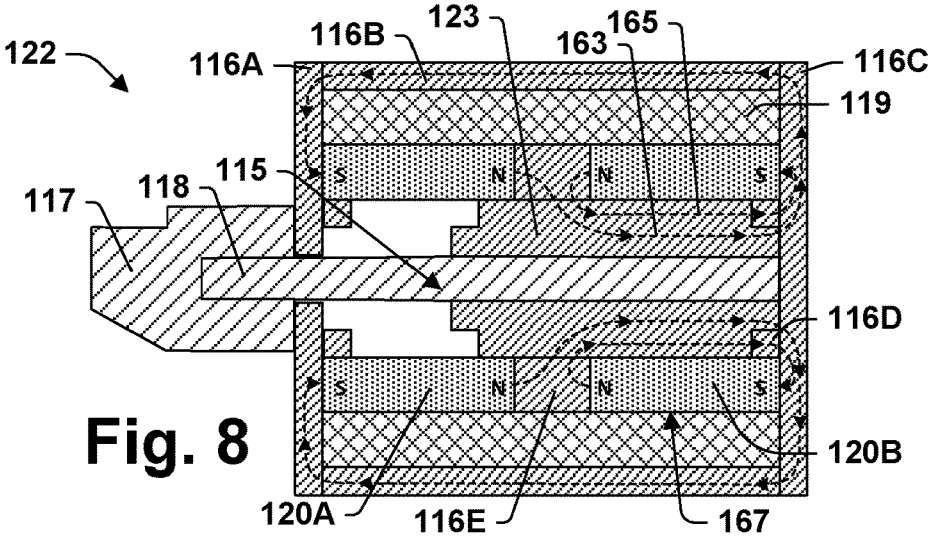
FIG. 8 provides the view of FIG. 6 but with the latch pin in a retracted position.

As shown in FIGS. 6 and 8, permanent magnet 120A stabilizes latch pin 115 in both the extended and the retracted positions. Electromagnetic latch assembly 122 forms two distinct magnetic circuits 162 and 163 to provide this functionality. As shown in FIG. 6, magnetic circuit 162 is the primary path for an operative portion of the magnet flux from permanent magnet 120A when latch pin 115 is in the extended position, absent magnetic fields from coil 119 or any external source that might alter the path taken by flux from permanent magnet 120A.

Magnetic circuit 162 proceeds from the north pole of permanent magnet 120A, through pole piece 116E, through latch pin 115, through pole piece 116D and pole piece 116A and ends at the south pole of permanent magnet 120A. Path 163 is the primary path for an operative portion of the magnet flux from permanent magnet 120A when latch pin 115 is in the extended position. A magnetic circuit is a primary path if it is a path taken by the majority of the flux. Perturbation of latch pin 115 from the extended position would introduce an air gap into magnetic circuit 162, increasing its magnetic reluctance. Therefore, the magnetic forces produced by permanent magnet 120A resist such perturbations.

As shown in FIG. 8, magnetic circuit 163 is the primary path for an operative portion of the magnet flux from permanent magnet 120A when latch pin 115 is in the retracted position, absent magnetic fields from coil 119 or any external source that might alter the path taken by flux from permanent magnet 120A. Magnetic circuit 163 proceeds from the north pole of permanent magnet 120A, through pole piece 116E, through latch pin 115, through a pole piece 116D, through pole pieces 116C, 116B, and 116A, and ends at the south pole of permanent magnet 120A. Path 163 is the primary path for an operative portion of the magnet flux from permanent magnet 120A when latch pin 115 is in the retracted position. Perturbations of latch pin 115 from the retracted position would introduce an air gap into magnetic circuit 162, increasing its magnetic reluctance. Therefore, the magnetic forces produced by permanent magnet 120A resist such perturbations.

In accordance with some aspects of the present teachings, electromagnetic latch assembly 122 also includes a second permanent magnet 120B that is also operative to stabilize latch pin 115 in both the extended and the retracted positions. Electromagnetic latch assembly 122 forms two distinct magnetic circuits 164 and 165 for magnetic flux from second permanent magnet 120B. Magnetic circuit 164 is the primary path for an operative portion of the magnet flux from permanent magnet 120B when latch pin 115 is in the extended position and magnetic circuit 165 is the primary path for an operative portion of the magnet flux from permanent magnet 120B when latch pin 115 is in the retracted position. Like magnetic circuit 162, magnetic circuit 165 goes around the outside of coil 119. Like magnetic circuit 163, magnetic circuit 164 does not.

Figure 7:
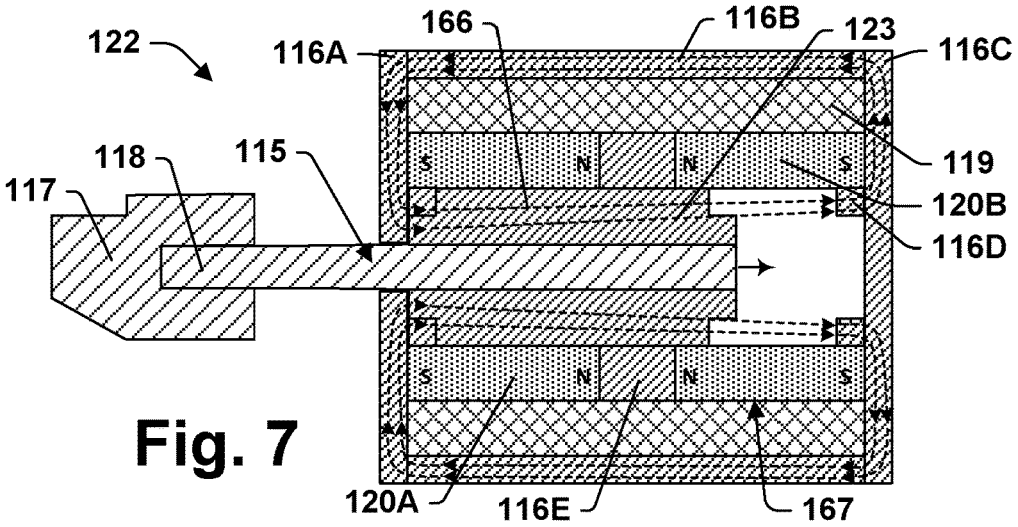
FIG. 7 provides the same view as FIG. 6, but illustrating magnetic flux that may be generated by the coil.

Electromagnetic latch assembly 122 is structured to operate through a magnetic circuit-shifting (flux path-shifting) mechanism. Electromagnetic latch assembly 122 is operative to actuate latch pin 115 between the extended and retracted positions by redirecting flux from permanent magnets 120. FIG. 7 illustrates the mechanism for this action in the case of operating coil 119 to induce latch pin 115 to actuate from the extended position to the retracted position. A voltage of suitable polarity may be applied to coil 119 to induce magnetic flux following the circuit 166. The magnetic flux from coil 119 reverses the magnetic polarity in low coercivity ferromagnetic elements forming the magnetic circuits 162 and 164 through which permanent magnets 120 stabilized latch pin 115 in the extended position. This greatly increase the reluctance of magnetic circuits 162 and 164. Magnetic flux from permanent magnets 120 may shift from magnetic circuits 162 and 164 toward magnetic circuits 163 and 165. The net magnetic forces on latch pin 115 may drive it to the retracted position shown in FIG. 8. In accordance with some aspects of the present teachings, the total air gap in the magnetic circuit 161 taken by flux from coil 119 does not vary as latch pin 115 actuates. This feature may relate to operability through a magnetic circuit-shifting mechanism.

One way in which electromagnetic latch assembly 122 may be identified as having a structure that provides for a magnetic circuit-shifting mechanism is that coil 119 does not need to do work on latch pin 115 throughout its traverse from the extended position to the retracted position or vis-versa. While permanent magnets 220 may initially holds latch pin 115 in a first position, at some point during latch pin 115's progress toward the second position, permanent magnets 220 begins to attract latch pin 115 toward the second position. Accordingly, at some point during latch pin 115's progress, coil 119 may be disconnected from its power source and latch pin 115 will still complete its travel to the second position. And as a further indication that a magnetic circuit-shifting mechanism is formed by the structure, a corresponding statement may be made in operation of coil 119 to induce actuation from the second position back to the first. Put another way, a permanent magnet 220 that is operative to attract latch pin 115 into the first position is also operative to attract latch pin 115 into the second position.

As used herein, a permanent magnet is a high coercivity ferromagnetic material with residual magnetism. A high coercivity means that the polarity of permanent magnet 120 remains unchanged through hundreds of operations through which electromagnetic latch assembly 122 is operated to switch latch pin 115 between the extended and retracted positions. Examples of high coercivity ferromagnetic materials include compositions of AlNiCo and NdFeB.

Magnetic circuits 162, 163, 164, 165 may be formed by low coercivity ferromagnetic material, such as soft iron. Magnetic circuits 162, 163, 164, 165 may have low magnetic reluctance. In accordance with some aspects of the present teachings, permanent magnets 120 have at least one low reluctance magnetic circuit available to them in each of the extended and retracted positions. These paths may be operative as magnetic keepers, maintaining polarization and extending the operating life of permanent magnets 120.

Low coercivity ferromagnetic pieces 116 may form a shell or can around coil 119. In some of these teachings, a rocker arm 103 to which coil 119 is mounted is formed of a low coercivity ferromagnetic material, such as a suitable steel, and the rocker arm 103 may be consider as providing these pieces or fulfilling their function.

In accordance with some aspects of the present teachings, magnetic circuits 162 and 165 are short magnetic circuits between the poles of permanent magnets 120A and 120B respectively. Magnetic circuits 162 and 165 pass through low coercivity ferromagnetic portion 123 of latch pin 115 but not around the loops of coil 119. These short magnetic circuits may reduce magnetic flux leakage and allow permanent magnets 120 to provide a high holding force for latch pin 115. Magnetic circuits 163 and 164, on the other hand, pass around the loops of coil 119. Routing these magnetic circuits around the outside of coil 119 may keep them from interfering with the shorter magnetic circuits. These longer, alternate magnetic circuits can allow permanent magnets 120 to contribute to stabilizing latch pin 115 in both extended and retracted positions and can assure there is a low reluctance magnetic circuit to help maintain the polarization of permanent magnets 120 regardless of whether latch pin 115 is in the extended or the retracted position.

Figure 18:
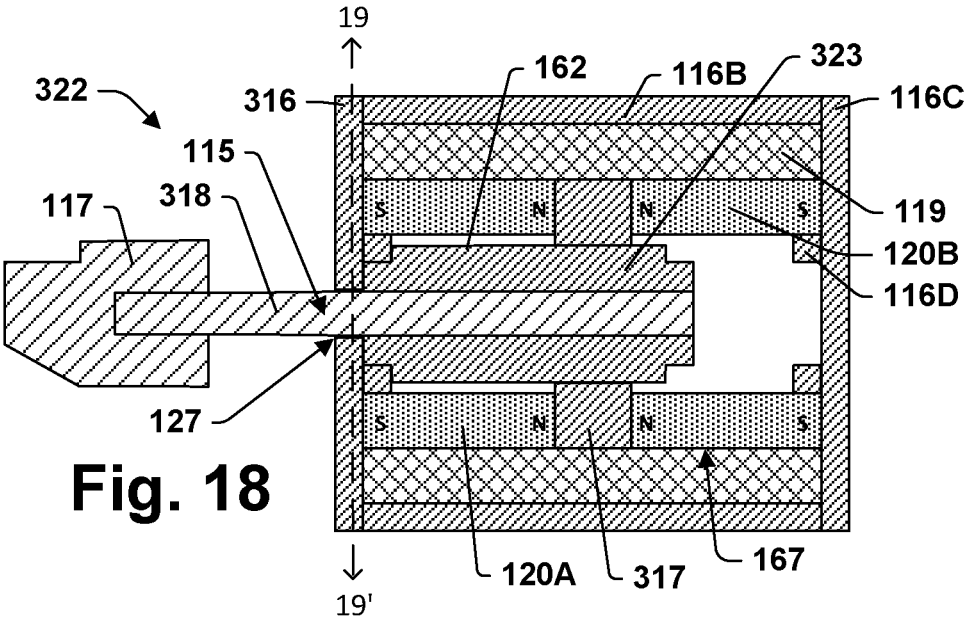
FIG. 18 is a cross-section side view of an electromagnetic latch assembly according to some aspects of the present teachings.

FIG. 18 illustrates electromagnetic latch assembly 322, which is generally similar to electromagnetic latch assembly 122. The differences are the following substitutions: latch pin body 318 in place of latch pin body 118, ferrule 323 in place of low coercivity ferromagnetic portion 123, pole piece 316 in place of low coercivity ferromagnetic piece 116A, and annular ring 317 in place of low coercivity ferromagnetic piece 116E. Annular ring 317 operates as a pole piece for magnets 120, but has a smaller inner diameter than magnets 120. As a result, latch pin 115 may make contact with annular ring 317 while not making contact with permanent magnets 120. Ferrule 323 has a slightly smaller outer diameter as compared to low coercivity ferromagnetic portion 123 to allow translation of latch pin 115 through annular ring 317. Ferrule 323 and annular ring 317 are made from low coercivity ferromagnetic material. Latch pin body 318 is made of paramagnetic material. For the purposes of this disclosure, a paramagnetic material is one that does not interact strongly with magnetic fields.

Figure 19:
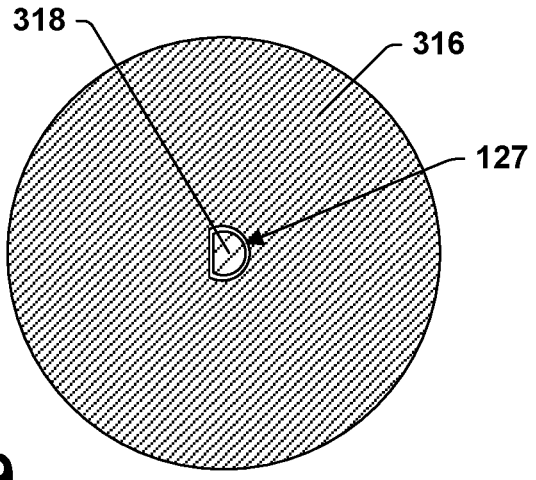
FIG. 19 is a cross-section taken along the line 19-19' of FIG. 18.

Pole piece 316 provides an end of a shell surrounding coil 119 and has an opening 127 through which latch pin 115 extends. As illustrated by FIG. 19, which provide a cross-section along line 19-19' of FIG. 18, opening 127 has a D-shape. Latch pin body 318 has a mating D-shaped profile. Accordingly, pole piece 316 cooperates with latch pin body 318 to restrict rotation of latch pin 115.

In accordance with some aspects of the present teachings, coil 119 is powered by circuitry (not shown) that allows the polarity of a voltage applied to coil 119 to be reversed. A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid's coil or the polarity of the resulting magnetic field. As described above, however, latch pin 115 of electromagnetic latch assembly 122 may be moved in either one direction or another depending on the polarity of the magnetic field generated by coil 119. Circuitry, an H-bridge for example, that allows the polarity of the applied voltage to be reversed enables the operation of electromagnetic latch assembly 122 for actuating latch pin 115 to either an extended or a retracted position. Alternatively, one voltage source may be provided for extending latch pin 115 and another for retracting latch pin 115. Another alternative is to provide two coils 119, one with windings in a first direction and the other with windings in the opposite direction. One or the other coil 199 may be energized depending on the position in which it is desired to place latch pin 115.

Figure 9:
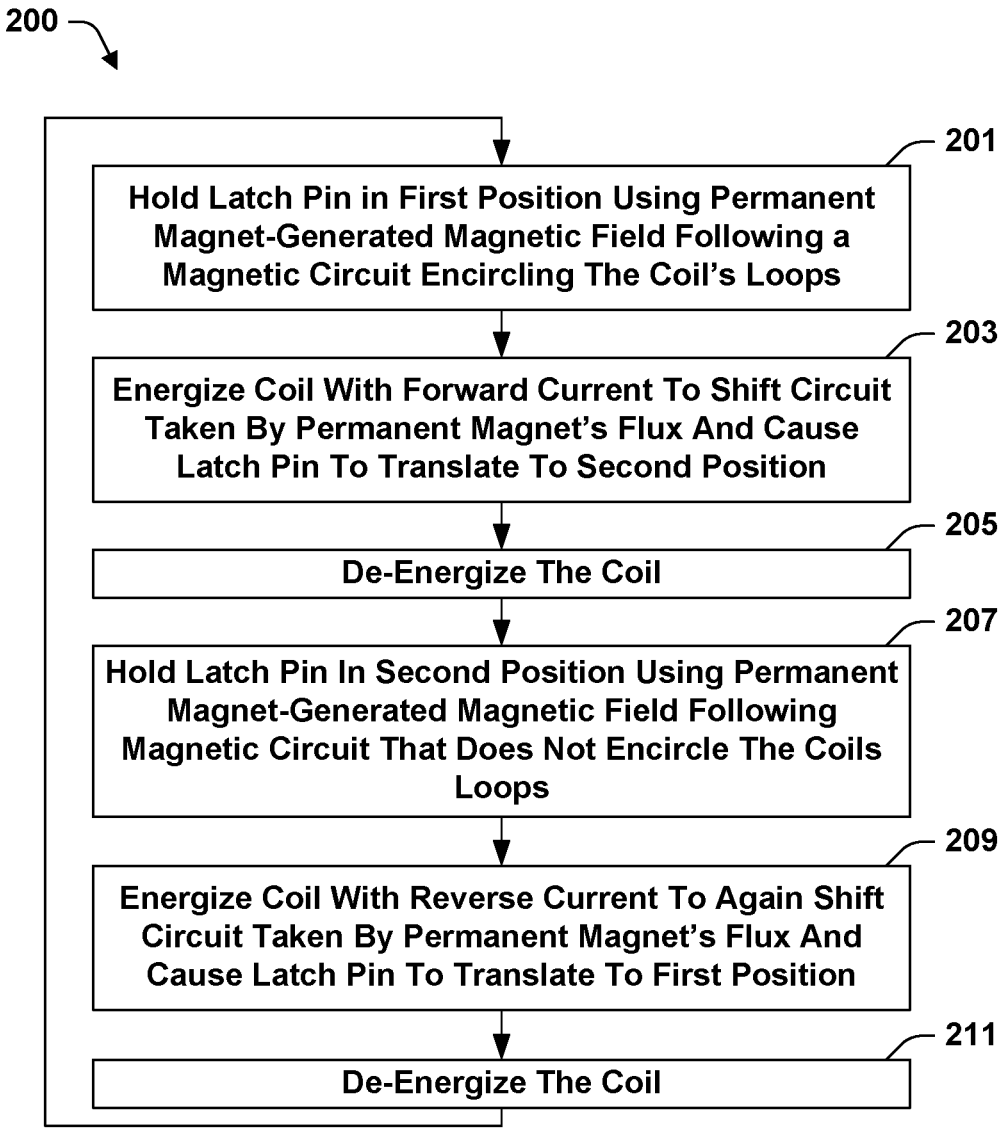
FIG. 9 is a flow chart of a method of operating an internal combustion engine, or a rocker arm assembly thereof, according to some aspects of the present teachings.

FIG. 9 provides a flow chart of a method 200 according to some aspects of the present teachings that may be used to operate internal combustion engine 102. Method 200 begins with action 201, holding latch pin 115 in a first position using a magnetic field generated by a first permanent magnet 120A and following a magnetic circuit 163 that encircles the windings of coil 119. Such a magnetic circuit may include a segment passing through coil 119 and a segment that is outside coil 119. The first position may correspond to either an extended or a retracted position for latch pin 115. In some of these teachings, action 201 further includes holding latch pin 115 in the first position using a magnetic field generated by a second permanent magnet 120B and following a shorter magnetic circuit 165 that does not encircles the windings of coil 119.

Method 200 continues with action 203, energizing coil 119 with a current in a forward direction to alter the circuit taken by flux from first permanent magnet 120A and cause latch pin 115 to translate to a second position. Energizing coil 119 with a current in a forward direction may also alter the circuit taken by flux from a second permanent magnet 120B. Action 203 may be initiated by an automatic controller. In some of these teachings, the controller is an ECU.

Following translation of latch pin 115 to the second position through action 203, coil 119 may be disconnected from its power source with action 205. Method 200 then continues with action 207, holding latch pin 115 in the second position using a magnetic field generated by a first permanent magnet 120A and following a magnetic circuit 162 that does not encircles the windings of coil 119. This may be a short magnetic circuit with low magnetic flux leakage. In some of these teachings, action 207 further includes holding latch pin 115 in the second position using a magnetic field generated by a second permanent magnet 120B and following a magnetic circuit 164 that encircles the windings of coil 119.

Method 200 may continue with action 209, energizing coil 119 with a current in a reverse direction to again alter the circuit taken by flux from first permanent magnet 120A. Action 209 causes latch pin 115 to translate back to the first position. Energizing coil 119 with a current in a reverse direction may also alter the circuit taken by flux from a second permanent magnet 120B. Action 209 also may be initiated by an automatic controller, such as an ECU. Action 211 may then be carried out, which is again de-energizing coil 119. The actions of method 200 may subsequently repeat.

In accordance with some aspects of the present teachings, electromagnetic latch assembly 122 has dual positional stability and may be operated by the method 200. In some of the present teachings, however, electromagnetic latch assembly 122 may alternatively be a different type of latch such as a conventional solenoid switch that forms a magnetic circuit that include an air gap, has a spring that tends to enlarge the air gap, and has an armature moveable to reduce the air gap. This conventional switch may have only one stable position, one maintained by a spring for example. The stable position may correspond to an extended or a retracted position for latch pin 115. The other position may be maintained by continuously powering coil 119.

Magnets of electromagnetic latch assembly 122 are housed in a chamber 126 formed in rocker arm 103A. The magnets housed in chamber 126 are permanent magnets 120A and 120B and coil 119. In accordance with some of these teachings, chamber 126 is sealed against intrusion from metal particles that may be in oil dispersed throughout the environment 105 surrounding rocker arm assembly 106. Openings off chamber 126 may be sealed in any suitable manner consistent with the objective. Chamber 126 may be sealed in part by a seal around latch pin 115 at a location where latch pin 115 extends out of chamber 126. Pole piece 116C or another component may seal off an opening through which parts of electromagnetic latch assembly 122 may have been installed in chamber 126.

In accordance with some aspects of the present teachings, chamber 126 is a hydraulic chamber. Chamber 126 may have been adapted to house parts of electromagnetic latch assembly 122. In accordance with some of these teachings, rocker arm assembly 106 is made using rocker arms 103 put into production for use with a hydraulically actuated latch. In accordance with some of these teachings, an electric latch assembly 122 has been installed in place of a hydraulic latch. While chamber 126 is a hydraulic chamber, it need not be functionally connected to a hydraulic system. A hydraulic passage 130 may connect to chamber 126. Hydraulic passage 130 may be blocked to help seal chamber 126. In some of these teaching, hydraulic passage 130 couples with a hydraulic passage 148 formed in hydraulic lash adjuster 140.

It has been determined that a coil 119 of sufficient power can be fit in chamber 126 of rocker arm 103A. In particular, simulations have shown that coil 119 may have a 7.2 mm outer diameter, a 2.5 mm inner diameter, and a 7.9 mm length. It may have 560 turns of 35 AWG copper wire. It may be powered at 9 VDC with a maximum current of 0.8 A. A peak electromagnetic force of 1.65 N on latch pin 115A may be realized with the aid of a shell 118 having a thickness of 0.5 mm. Latch pin weight can be limited to about 2 g. Frictional resistance may be limited to 0.6 N@0° C., with much lower friction expected at higher temperatures. Under these conditions, coil 119 may drive latch pin 115 through a distance of 1.9 mm in 4 ms. In some of the present teachings, coil 119 has a diameter of 20 mm or less. In some of these teachings, coil 119 has a diameter of 10 mm or less. These dimensions facilitate fitting coil 119 into a chamber 126 formed in rocker arm 103A.

In some of the present teachings, the displacement required to actuate latch pin 115 from the first the second position is 5 mm or less, e.g., about 2 mm. Actuating latch pin 115 may be operative to change valve lift timing. In some of these teachings, Rocker arm assembly 106 is a cylinder deactivating rocker arm and actuating latch pin 115 activates or deactivates valve 152. In some alternative teachings, rocker arm assembly 106 is a switching rocker arm. A switching rocker arm may be operative to provide VVL. A switching rocker arm may include an inner arm 103B and an outer arm 103A that are selectively engaged by a latch pin 115 and actuating latch pin 115 switches the valve lift timing between a first profile and a second profile.

Figure 10:
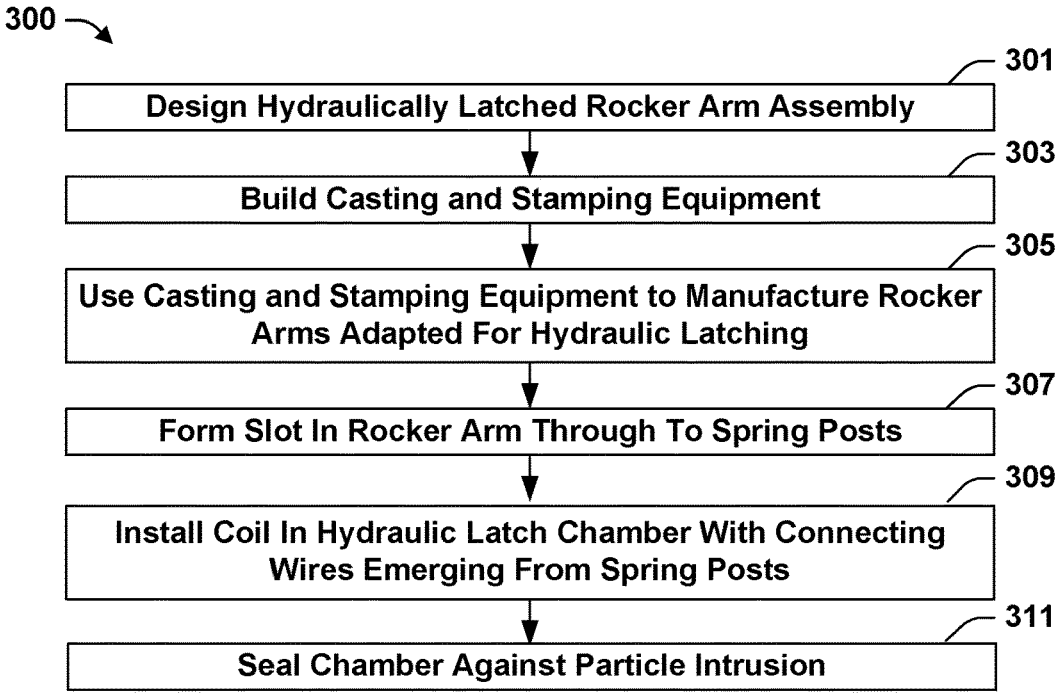
FIG. 10 is a flow chart of a manufacturing method according to some aspects of the present teachings.

FIG. 10 provides a flow chart of a manufacturing method 300 in accordance with some aspects of the present teachings. Method 300 begins with action 301, a design operation in which a rocker arm assembly 106 including a hydraulically actuated latch may be designed in detail. The design may be made without specifications for an electromagnetic latch assembly 122. Method 300 continues with action 303, building casting and stamping equipment sufficient for implementing the design of action 301. Action 305 is using that equipment to manufacture a rocker arm 103A having a hydraulic chamber 126.

Figure 11:
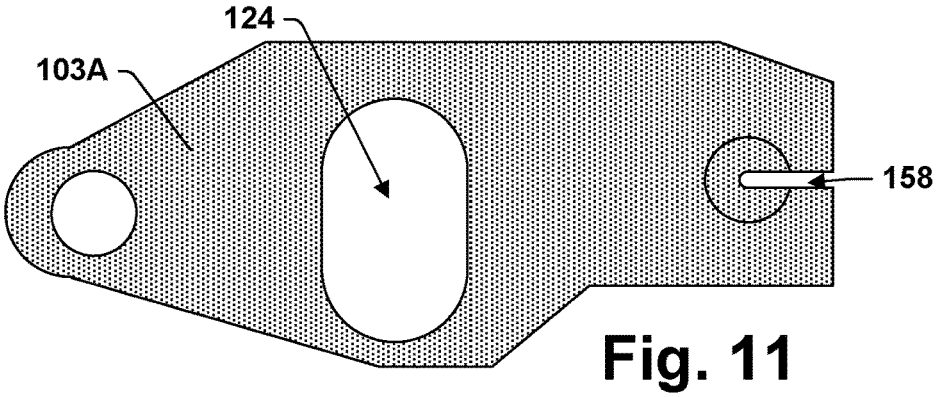
FIG. 11 is a side view of a rocker arm having a slot in accordance with some aspects of the present teachings.
Figure 12:
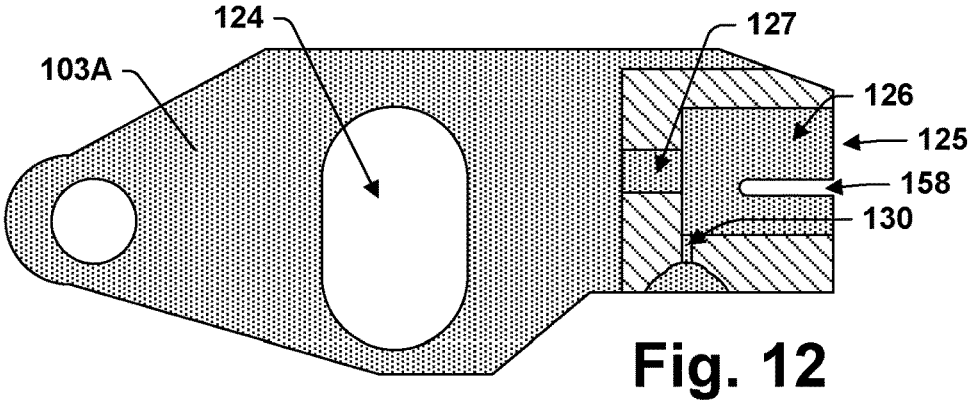
FIG. 12 is a cutaway view corresponding to the side view of FIG. 11.
Figure 13:
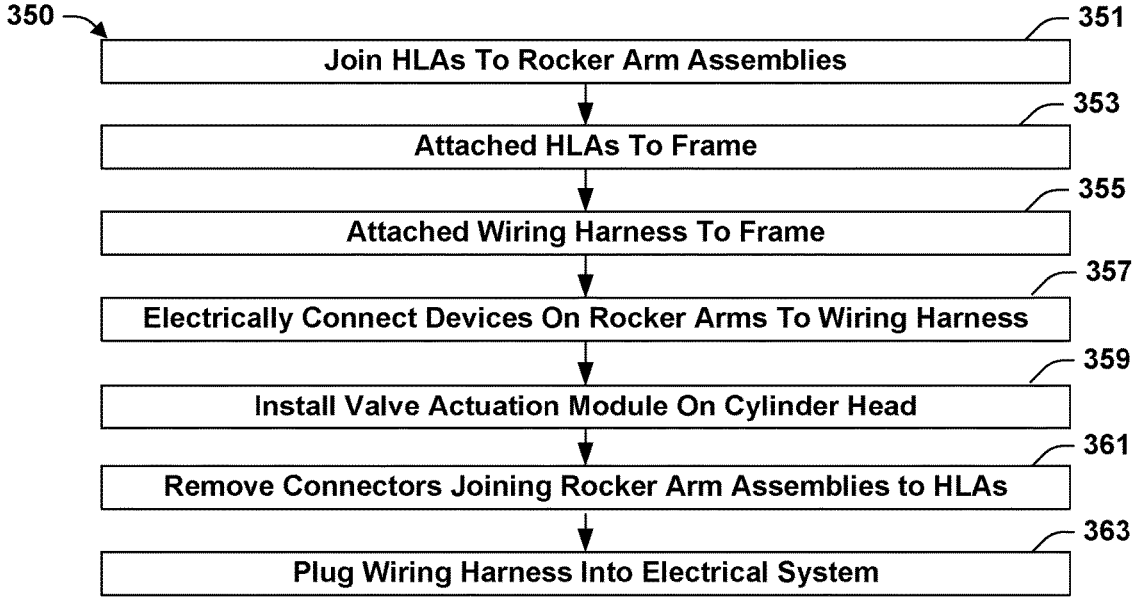
FIG. 13 is a flow chart of a manufacturing method according to some other aspects of the present teachings.

Act 307 is an optional step of forming a slot 158 in end 110 of rocker arm 103A through to spring posts 157 as shown in FIGS. 11 and 12. Slot 158 intersects chamber 126. Act 309 is installing coil 119 in chamber 126. If act 307 has been performed, act 309 may include installing coil 119 in chamber 126 with wires 175 emerging from one of the spring posts 157 as shown in FIG. 13. In some of these teachings, wires 175 emerge from both spring posts 157. In some of these teachings, however, coil 119 is grounded through the structure of rocker arm assembly 106 which is in turn grounded through cylinder head 154. In that case, only one wire is required. That wire can be electrically isolated from cylinder head 154 and raised to a substantially higher electrical potential. Optionally, action 309 includes installing the entire electromagnetic latch assembly 122 on rocker arm 103.

Action 311 is an optional step of sealing hydraulic chamber 126 against intrusion by metal particles that may be in oil dispersed in the environment 105 surrounding rocker arm assembly 106. This may include installing a seal ring around an opening 127 out of which latch pin 115 extends and/or closing off an opening 125 through which electromagnetic latch assembly 122 is installed in chamber 126. In some of these teachings, electromagnetic latch assembly 122 itself forms a sealed chamber within hydraulic chamber 126. Electromagnetic latch assembly 122 may be provided with a shell for this purpose. In some of these teachings, electromagnetic latch assembly 122 cooperates with the structure of rocker arm 103A to complete the sealing of chamber 126.

Figure 14:
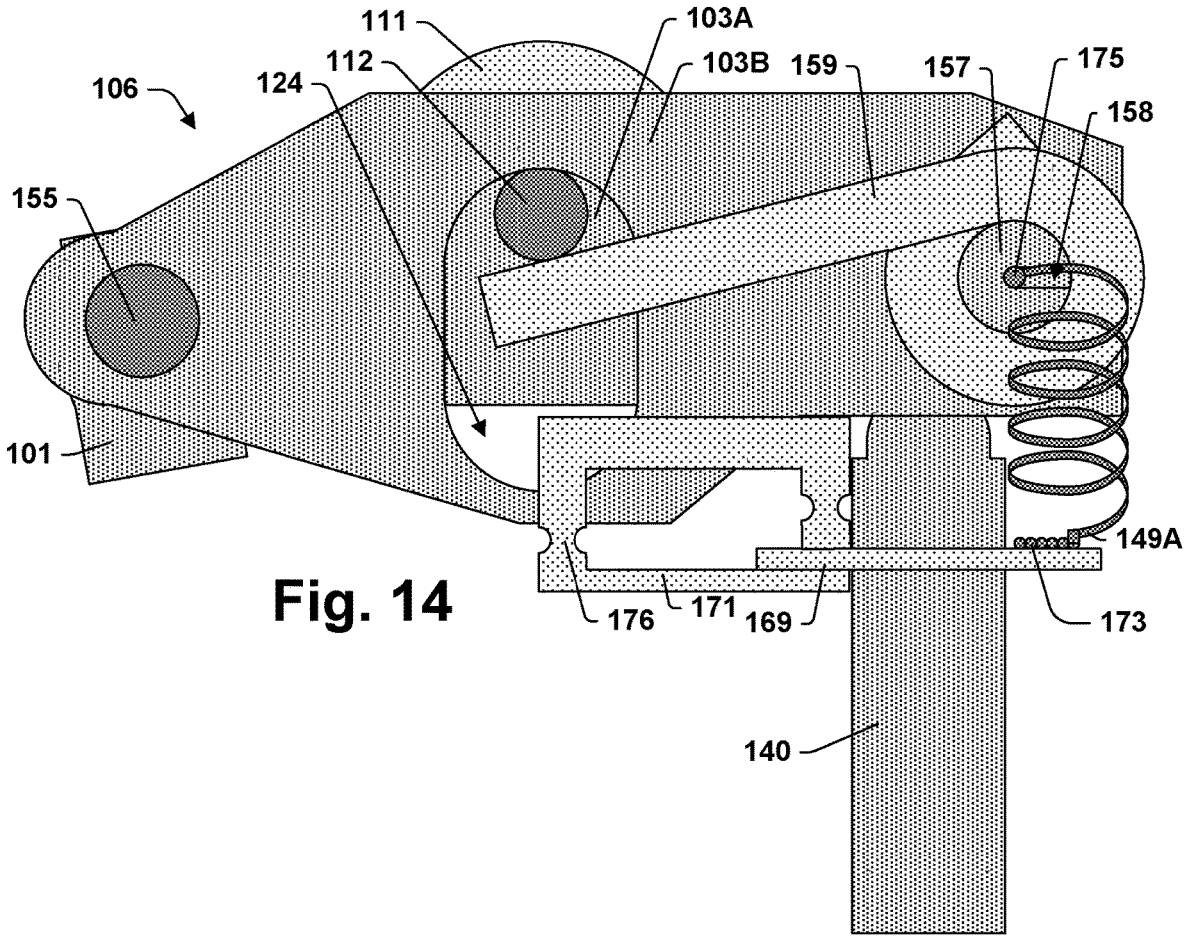
FIG. 14 is a side view of a portion of the rocker arm assembly of FIG. 1 prior to installation in accordance with some aspects of the present teachings.
Figure 17:
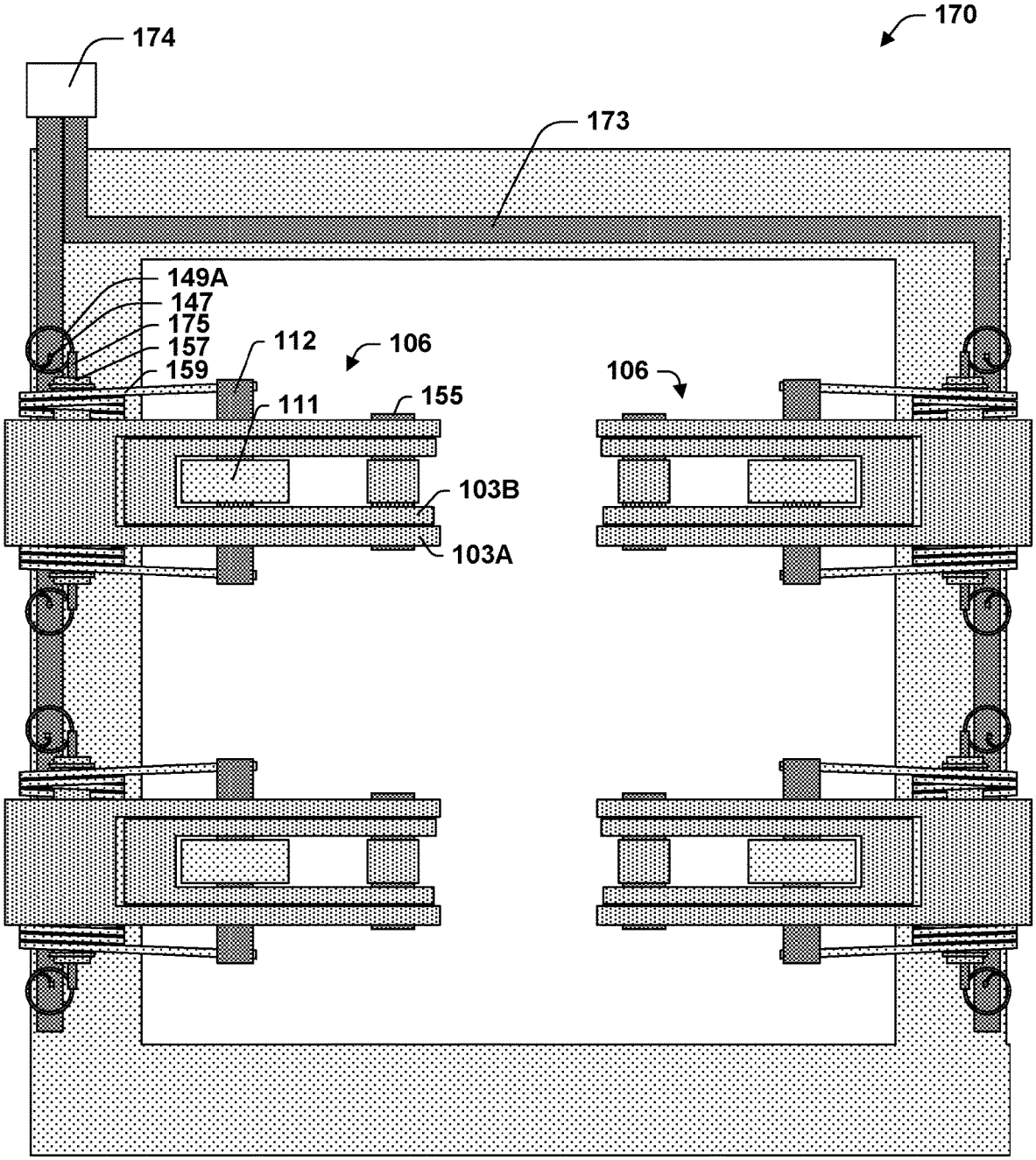
FIG. 17 illustrates a valve actuation module according to some aspects of the present teachings.

FIG. 13 is a flow chart of a method 350 of manufacturing an internal combustion engine 102. Method 350 may include forming a valve actuation module 170 as shown in FIG. 17. Method 350 may begin with action 351, temporarily joining rocker arm assemblies 106 to pivots 140. These parts may be joined with connectors 171 as shown in FIG. 14. Connectors 171 may be any type of connector that can hold rocker arm assemblies 106 and pivots 140 together during installation and can be easily removed after installation. Connectors 171 may be made of plastic or cardboard. Connectors 171 may be formed of a material unsuited for engine operating conditions. In some of these teachings, connectors 171 have weak points 176 formed or designed into their structure. Connectors 171 may be identifiable as breakaway connectors. Connectors 171 may join rocker arms 103 and pivots 140 directly, or may join rocker arms 103 to a frame 168 to which pivots 140 are joined. Alternatively, connectors 171 may be simply removable connectors.

Method 350 may include action 353, attaching pivots 140 to frame 169. In accordance with the present teachings, frame 169 maintains spacing between pivots 140 that is equivalent to their spacing when installed within internal combustion engine 102. In some of these teachings, frame 169 wraps at least most of the way around a cylindrical portion of each of the pivots 140.

Action 355 is attaching a wiring harness 168 to frame 169. Wiring harness 168 may include a plurality of wires 173 connecting to distinct pivots 140. Each of the wires 173 may be coupled to a separate pin of connection plug 174. Wiring harness 168 may provide a conduit surrounding and protecting wires 173. Wires 173 may be enclosed within frame 169.

Figure 15:
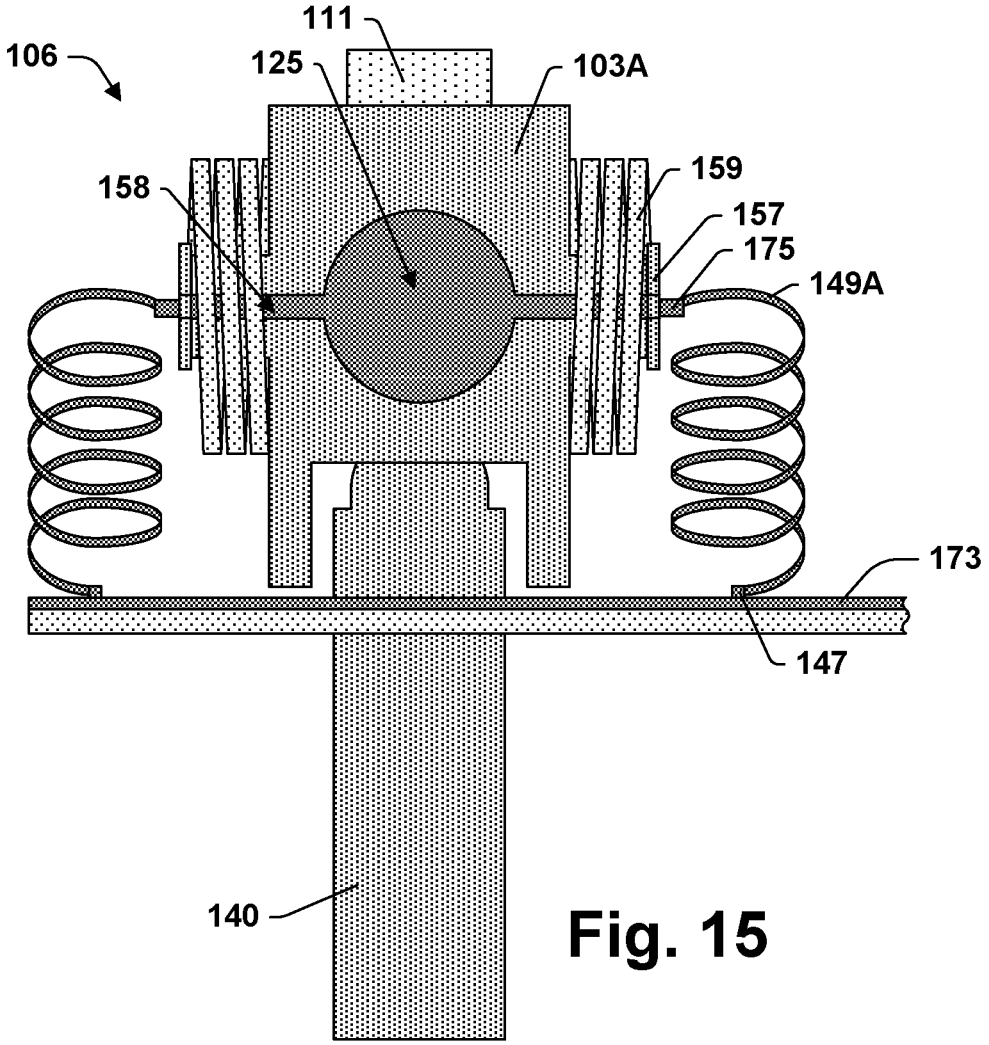
FIG. 15 is another view of the valvetrain of FIG. 1, this view including a review of the rocker arm assembly shown in FIG. 1.

Action 357 is installing connectors 149 that make electrical connections between wires 173 of wiring harness 168 and coils 119. In accordance with some aspects of the present teachings, the connections are made with springs 149A as shown in FIGS. 14 and 15. Springs 149 may have a natural frequency greater than 500 Hz. The same springs 149 that provide this degree of stiffness may also be operative to carry current form coil 119. Alternatively, wire traces may be provided on the springs 149 for carrying the current. Another option is to bind current carrying wires along the length of the springs 149. Bound along the length means continuously bound or multiple bindings distributed along the length.

Figure 16:
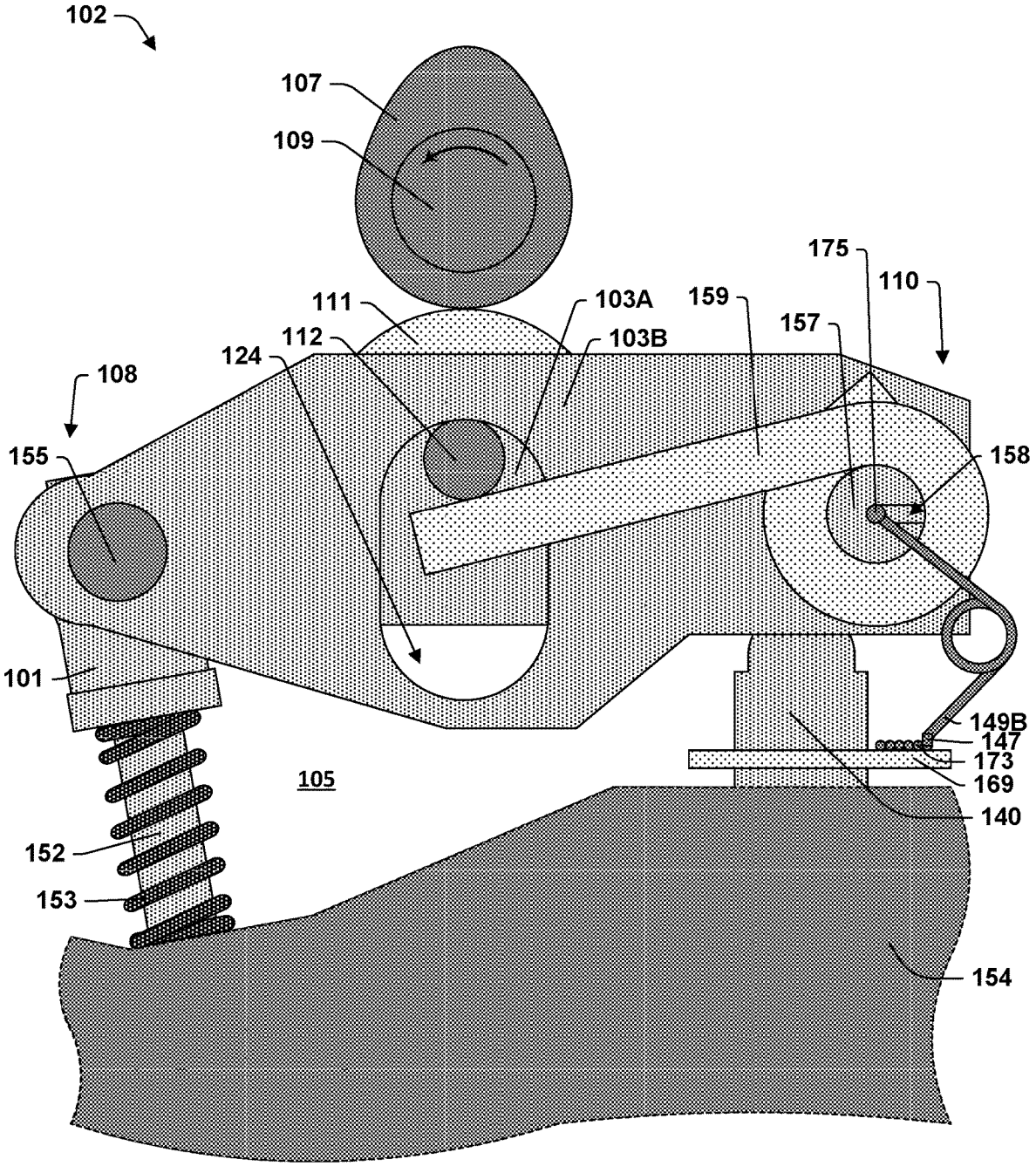
FIG. 16 is a side view of a portion of an internal combustion including a valvetrain according to some other aspects of the present teachings.

Springs 149 may be any suitable type of spring. In most of the illustrations, spring 149 are shown as being formed from a coiled metal ribbon. FIG. 16 shows an alternative design with springs 149B in the form of spring clips. The present teaching of using springs 149 to form electrical connections to a rocker arm 103 are applicable to powering or communicating with any type of electrical device that may be mounted on rocker arm 103. The connection may be made from rocker arm 103 to any suitable location. A suitable location may be stationary with respect to cylinder head 154.

In some of the present teachings, springs 149 are used to form connections to a wiring harness. In some of these teachings, the wiring harness is mounted to a frame 169. Frame 169 may be mounted at any suitable location. A suitable location may be stationary with respect to cylinder head 154. In some of these teachings frame 169 is mounted to pivots 140. In some of these teachings frame 169 is mounted to cylinder head 154, a cam carrier (not shown), or a valve cover (not shown). In alternate teachings, springs 149 make connections to a wiring harness that is mounted directly to a pivot 140, a cylinder head 154, a cam carrier, or a valve cover.

Alternatively, coils 119 may be electrically connected to a wiring harness without springs. For example, the connections can be made with wires that are specially designed to endure the motion induced by rocker arm 103A. If such wires are used, they may be connected to coils 119 prior to mounting on rocker arm 103A in accordance with method 300. According to some aspects of the present teachings, prior to mounting coil 119 on rocker arm 103A, wires are connected to coil 119 having sufficient length to run continuously from coils 119 to a connection plug 174. Such wires can be gathered together to form wiring harness 168.

Actions 351 through 357 together form a valve actuation module 170 in accordance with some aspects of the present teachings. A valve actuation module 170 in accordance with these teachings is illustrated by FIG. 17. In accordance with some of these teachings, valve actuation module 170 includes at least two rocker arm assemblies 106. In some of these teachings, valve actuation module 170 includes four rocker arm assemblies 106. Four rocker arm assemblies 106 may be the number installed between adjacent pairs of cam towers (not shown) in engine 102. In accordance with some of these teachings, valve actuation module 170 includes electrical connections for a plurality of coils 119.

Action 359 is installing valve actuation module 170 in cylinder head 154. In accordance with the present teachings, this may include installing all the pivots 140 of valve actuation module 170 simultaneously in openings formed in cylinder head 154. Action 359 may be simply dropping valve actuation module 170 onto cylinder head 154. Action 361 is removing the connectors 171 joining rocker arms 103 to pivots 140 or frame 169. Action 363 is plugging connection plug 174 into the electrical system (not shown) of internal combustion engine 102. The actions of method 350 may take place in any order consistent with the logic of this method.

Figure 20:
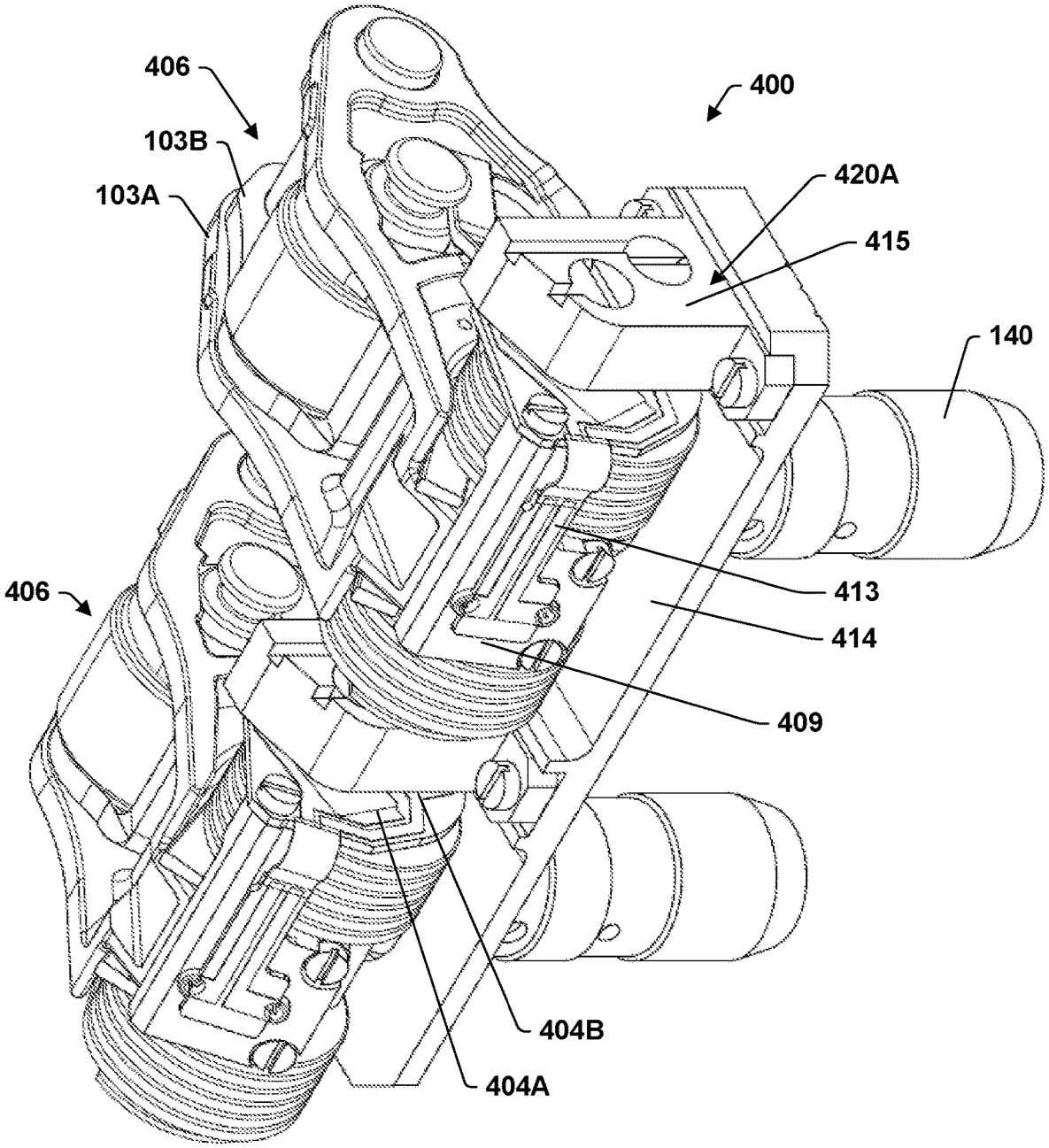
FIG. 20 is a perspective view of a portion of a valvetrain according to some aspects of the present teachings.
Figure 21:
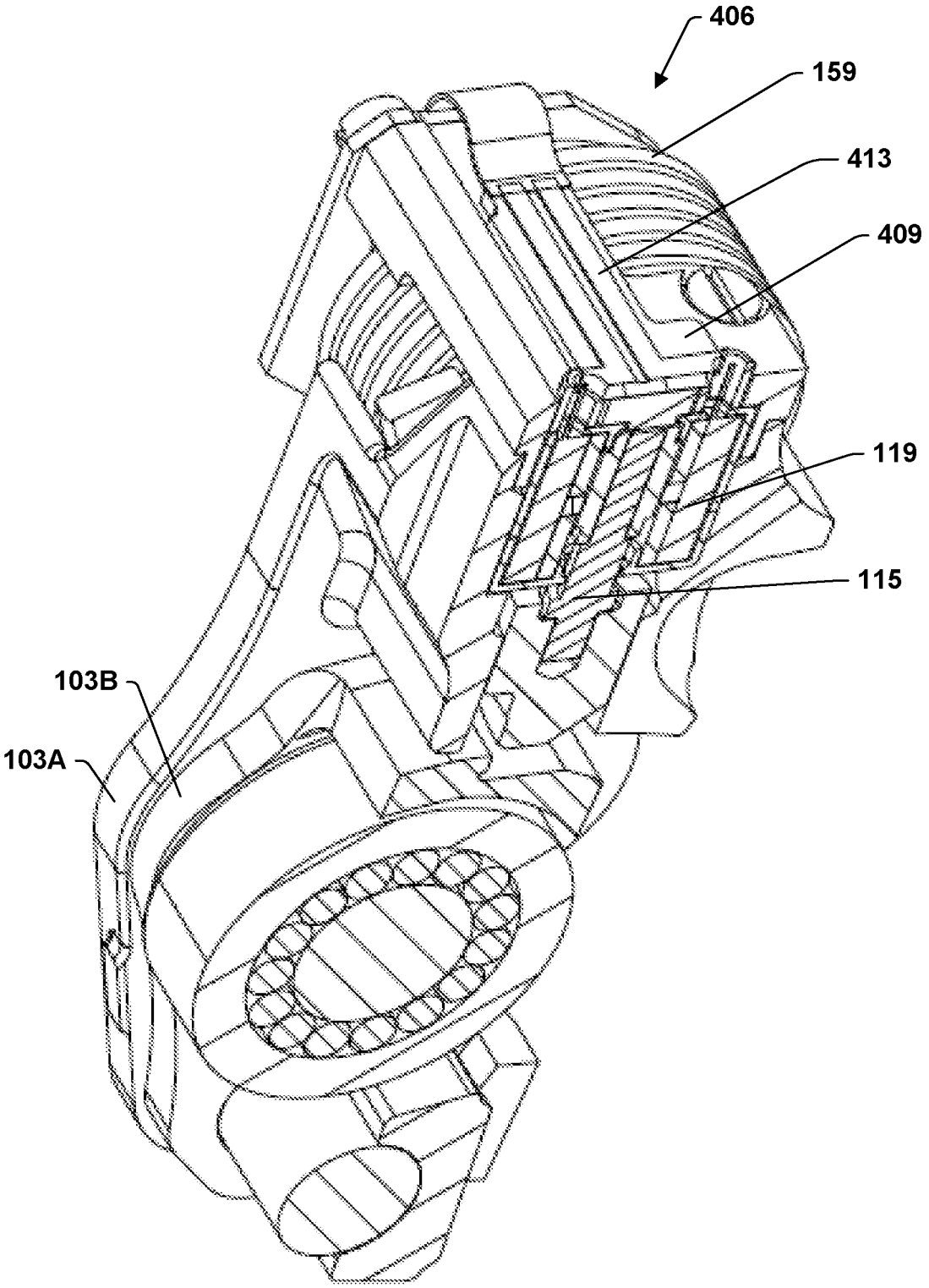
FIG. 21 is another perspective view of the valvetrain of FIG. 20, this view including a cross-section of one of the rocker arm assemblies.
Figure 22:
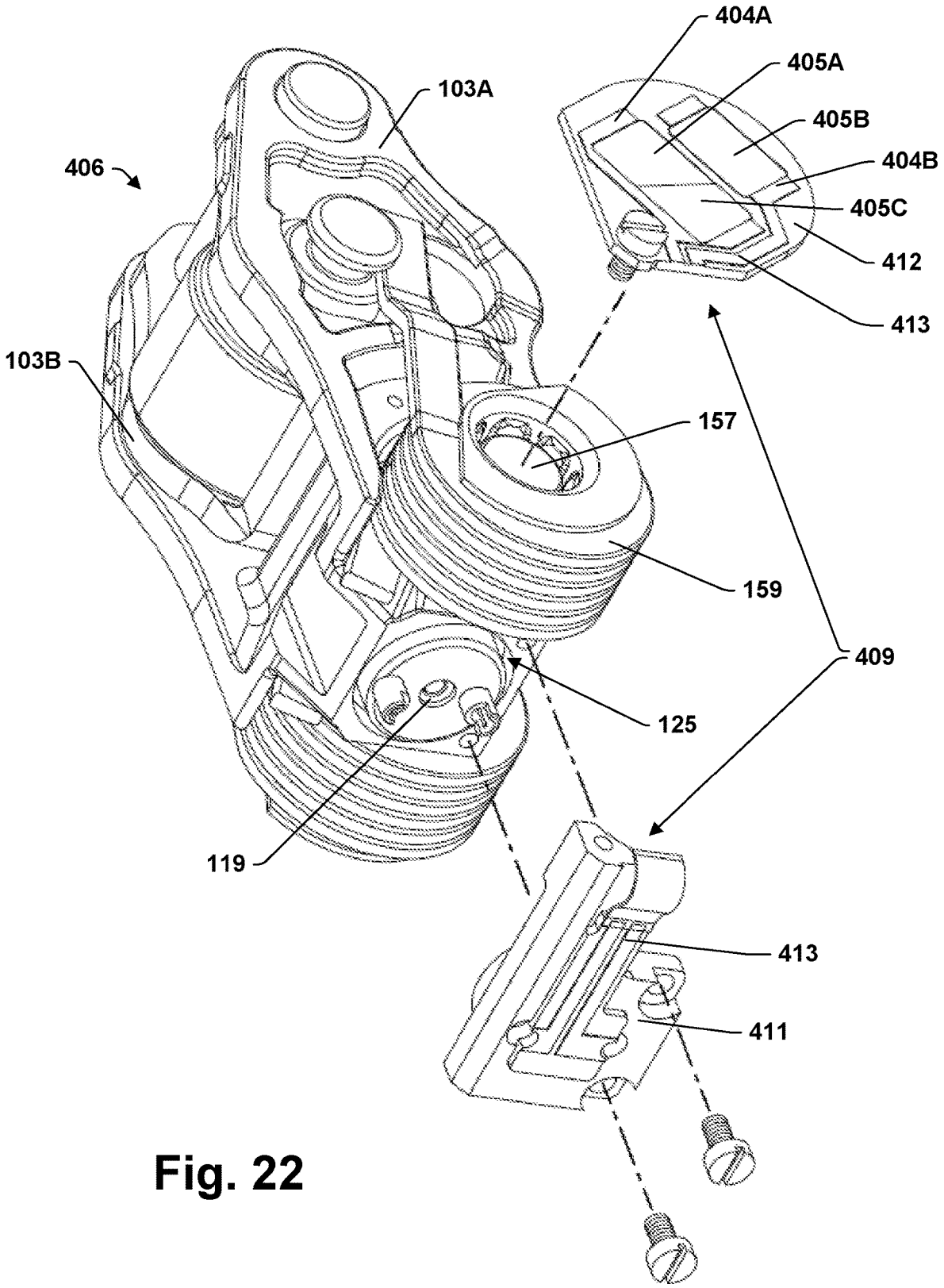
FIG. 22 is a partially exploded view illustrating the way in which contact pads are mounted to a rocker arm assembly of FIG. 20.

FIG. 20-23 illustrates parts of a valvetrain 400 suitable for engine 102. As shown in FIG. 20, valvetrain 400 includes at least two rocker arm assemblies 406 that are generally similar to rocker arm assemblies 106. With further reference to FIGS. 21 and 22, rocker arm assemblies 406 include an outer arm 103A, an inner arm 103B, and contact pads 404A and 404B held to one side of outer arm 103A over spring post 157.

Figure 23:
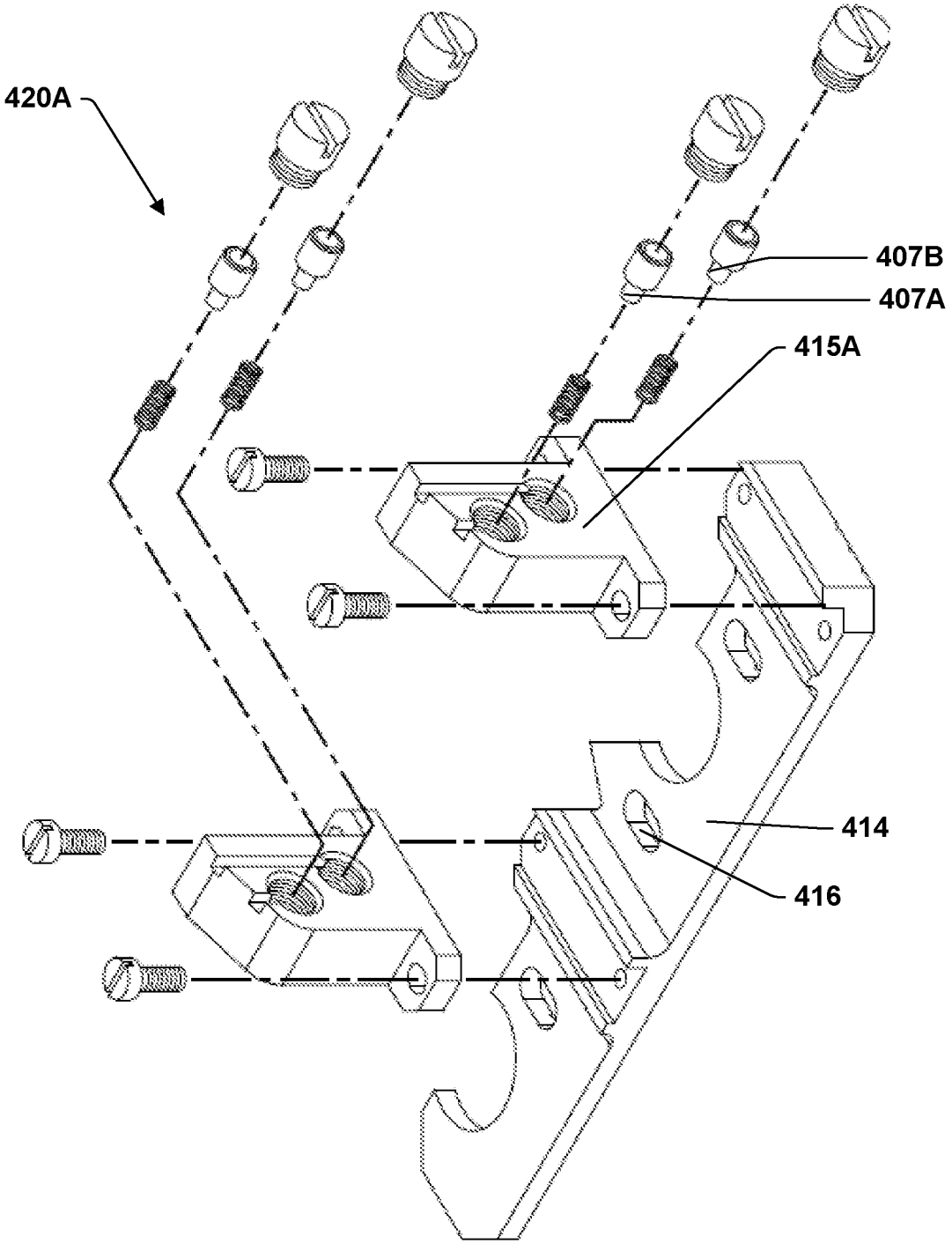
FIG. 23 is an exploded view of a mounting frame for spring loaded contact pins which is part of the valvetrain illustrated in FIG. 20.

Valvetrain 400 further includes a framework 420A that holds spring loaded pins 407A and 407B against contact pads 404A and 404B respectively, at least when rocker arm 103A is on base circle. As shown in FIG. 23, framework 420A includes a base plate 414 and slip ring towers 415A that hold spring loaded pins 407 in abutment with contact pads 404. The abutment completes a circuit that provides power to a coil 119 that is operative to actuate latch pin 115. Contacts pads 404, coil 119, and latch pin 115 are all mounted to outer arm 103A. Wires 413 couple coil 119 to contact pads 404.

With reference to FIG. 22, contact pads 404A and 404B have planar contact surfaces 405A and 405B respectively. Each rocker arm assembly 406 pivots on pivot 140. Outer arm 103A and inner arm 103B are free to pivot relative to one-another except when they are engaged by latch pin 115. Pivot 140 may raise or lower rocker arm assembly 406 to adjust lash. These motions take rocker arm 103A in directions parallel to the plane in which the planar contact surfaces contact pads 404A and 404B are oriented. Accordingly, the connections between contacts pads 404 and spring loaded pins 407 may be maintained as outer arm 103A goes through its range of motion.

In some of these teachings, spring loaded pin 407B remains in abutment with contact surface 405B throughout rocker arm 103A's range of motion. In some of these teachings, spring loaded pin 407A remains in abutment with contact surface 405A through only a portion of rocker arm 103A's range of motion. Contact pad 404A may be structured and positioned such that as rocker arm 103A is lifted off base circle, spring loaded pin 407A moved from abutment with contact surface 405A to abutment with contact surface 405C. Connection through contact surface 405C may present a distinctly higher resistance than connection through contact surface 405A. The higher resistance may be provided by a coating on contact surface 405C that is not present on contact surface 405A. In some of these teachings, that coating is a diamond-like carbon (DLC) coating. The difference in resistance may be used to detect the position of rocker arm 103A.

Latch pin 115 may be installed in rocker arm 103A through opening 125 at the back of rocker arms 103A. Coil 119 is also installed in rocker arm 103A through opening 125. Wires 413, which couple coil 119 to contact pads 404, run out of rocker arm 103A through opening 125. Wires 413 continue around the side of rocker arm 103A to connect with contact pads 404. In some of these teachings, wires 413 and contact pads 404 are supported by a contact frame 409 that mounts to rocker arm 103A within opening 125.

As shown in FIG. 22, contact frame 409 may include a part 411 held at the back of rocker arm 103A and a part 412 held to the side of rocker arm 103A. In some of these teachings, however, parts 411 and 412 are provided as a single part. In some of these teachings, that single part is formed by over-molding wires 413 and contact pads 404. Contact frame 409 may be press fit into opening 125.

As shown in FIG. 23, base plate 414 may include cutouts 424 that fit around pivots 140. When framework 420 is installed in engine 102, baseplate 414 may rest atop cylinder head 154 and abut two pivots 140. Cutouts 424 may cooperate with pivots 140 to ensure proper positioning of framework 420 with respect to rocker arm assemblies 406 and therefore proper position of spring loaded pins 407 with respect to contact pads 404. Framework 420 may be secured to cylinder head 154 by bolts passing through openings 416.

Figure 24:
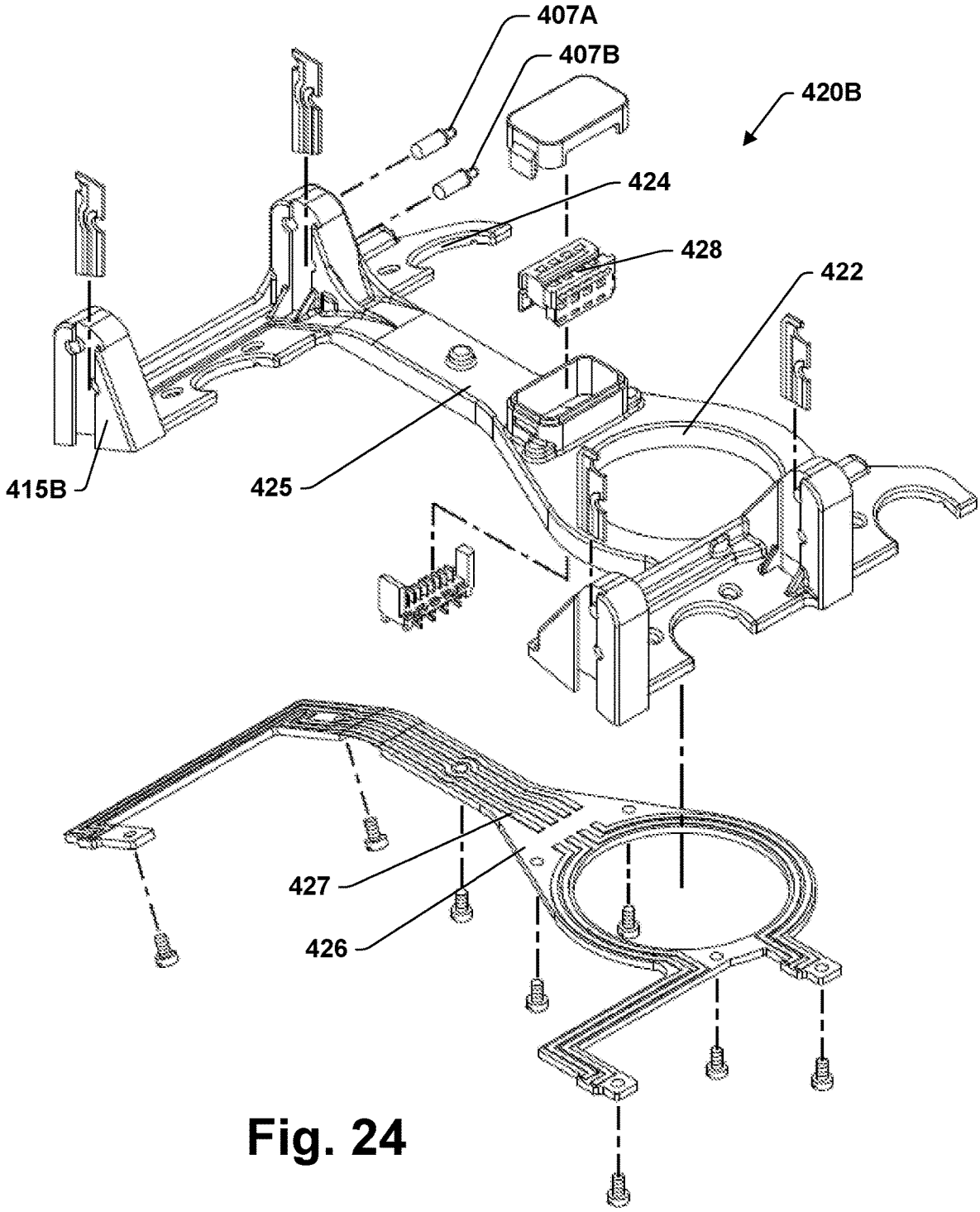
FIG. 24 is an exploded view of a wiring harness according to some aspects of the present teachings.
Figure 25:
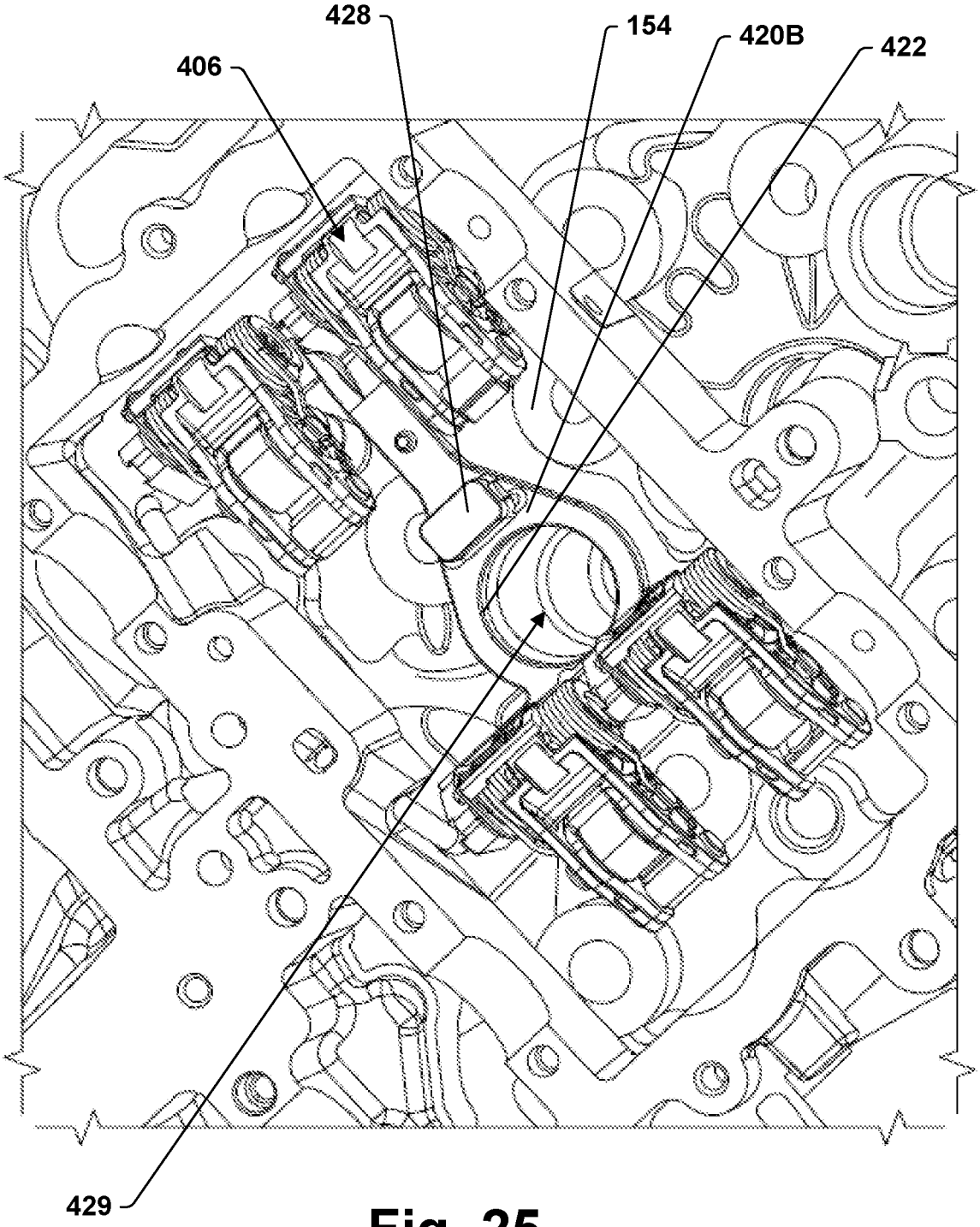
FIG. 25 is a perspective view of a partially manufacture engine in which portions of a valvetrain including the wiring harness of FIG. 24 have been installed.

FIG. 24 illustrates a mounting frame 420B that may be used instead of mounting frame 420A. Mounting frame 420 may be made of plastic. Mounting frame 420B includes an opening 422 that may fit closely around a spark plug tower (not shown) when mounting frame 420B is installed on a cylinder head 154. FIG. 25. shows mounting frame 420B installed on cylinder head 154 with opening 422 positioned above an opening 429 in cylinder head 154 for a spark plug tower. The spark plug tower may be installed before or after frame 420B. Mounting frame 420B may also include four semi-circular cutouts 424 that fit against pivots 140. When engine 102 is fully assembled with frame 420B, a spark plug tower fits through opening 422, cutouts 424 abut pivots 140, and the position of frame 420 is thereby secured. The position of frame 420 may be further secured by fastening frame 420 to cylinder head 154.

As shown in FIG. 24, mounting frame 420B includes an upper part 425 and a lower part 426 that may be fastened together around wires 427 to provide a wiring harness in which wires 427 are isolated from the surrounding environment. Slip ring towers 415B may be attached to frame 420B. Alternatively, frame 420B may include slip ring towers 415B as part of a unitary structure. Slip ring towers 415B support spring loaded pins 407 that make electrical connections between wires 427 and contact pads 404.

As shown in FIG. 25, frame 420B provides a connection plug 428 adjacent a location 429 for a spark plug tower. Plug 428 is for connecting wires 427 to a vehicle power system. The wires from plug 428 may pass through the valve cover (not shown) adjacent the spark plug tower (not shown). Alternatively, those wires may enter the spark plug tower below the valve cover and exit the spark plug tower above the valve cover. A valve actuation module according to the present teachings may be formed by temporarily securing pivots 140 and rocker arm assemblies 406 to frame 420. The valve actuation module is easily installed in engine 102.

Figure 26:
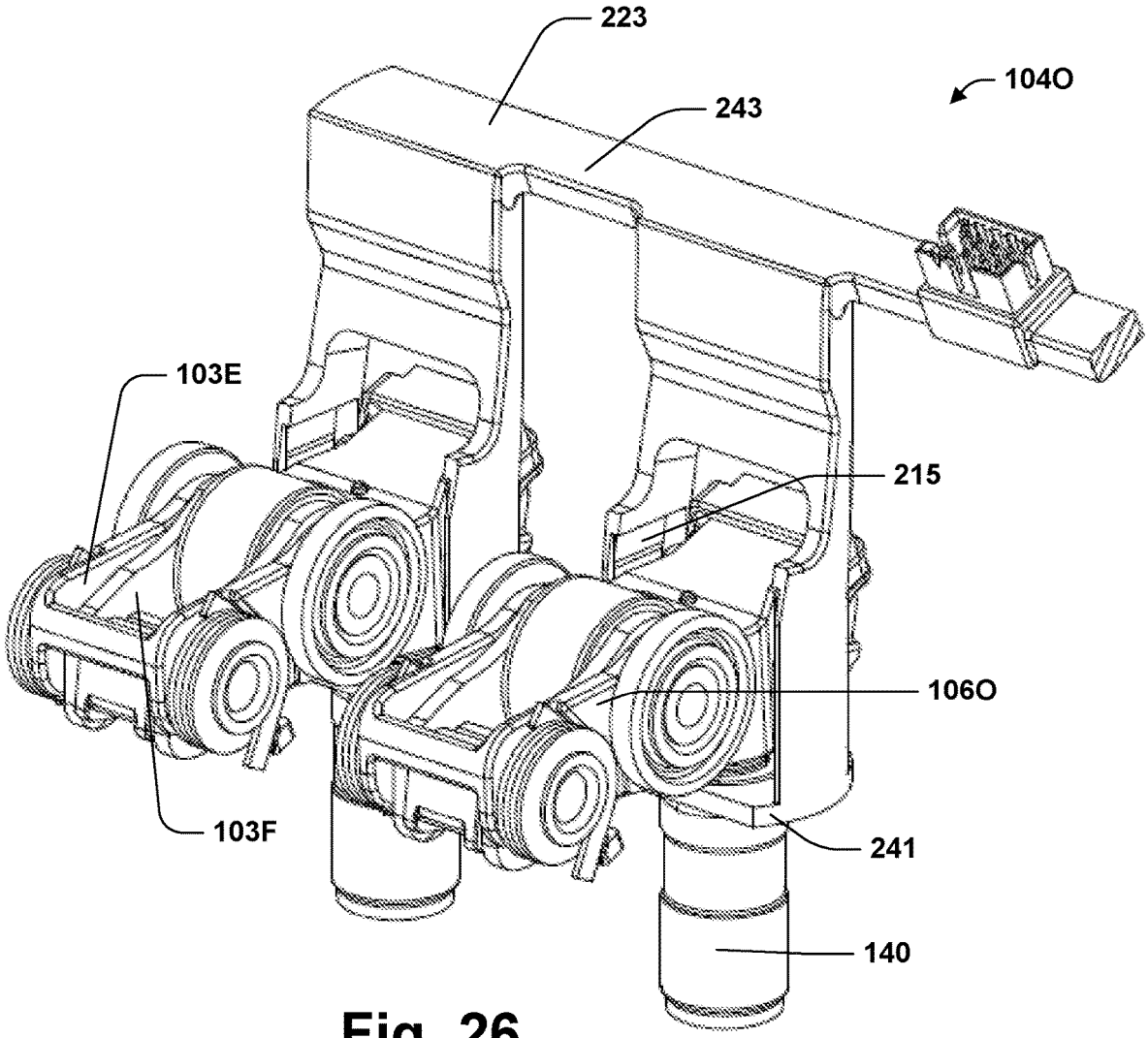
FIG. 26 is a perspective view of a portion of a valvetrain according to some aspects of the present teachings.
Figure 27:
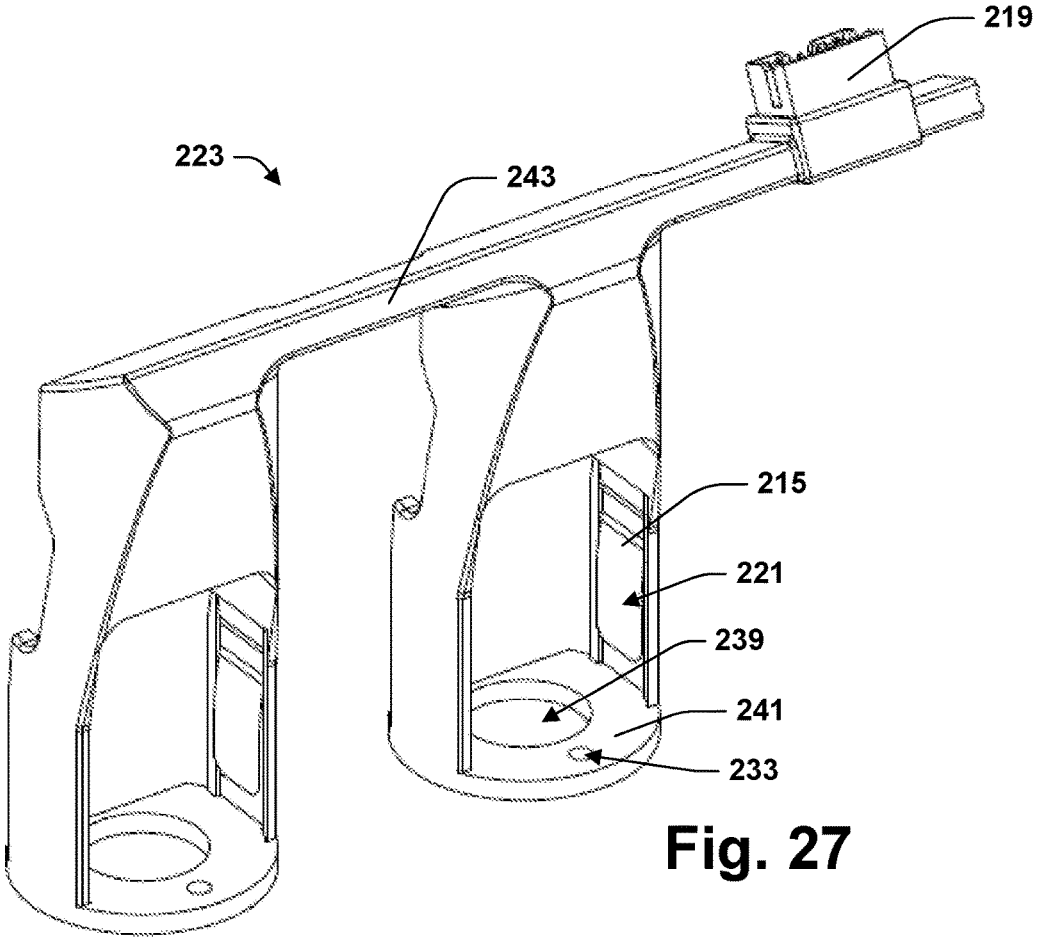
FIG. 27 is a perspective view of a lead frame that holds spring loaded contacts in the valvetrain of FIG. 26.
Figure 28:
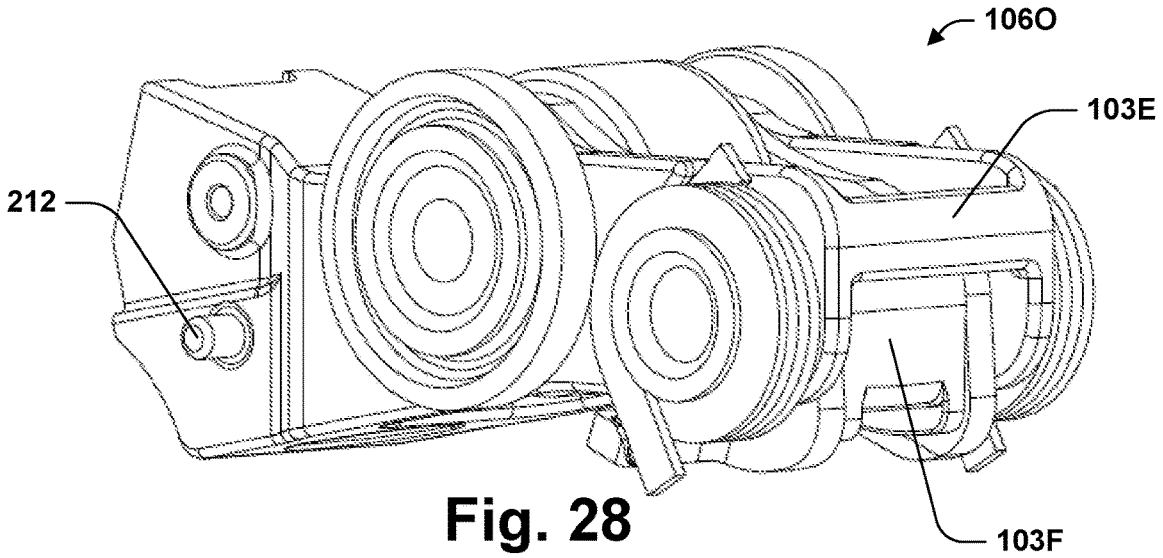
FIG. 28 is a perspective view of one of the rocker arm assemblies in the valvetrain of FIG. 26.
Figure 29:
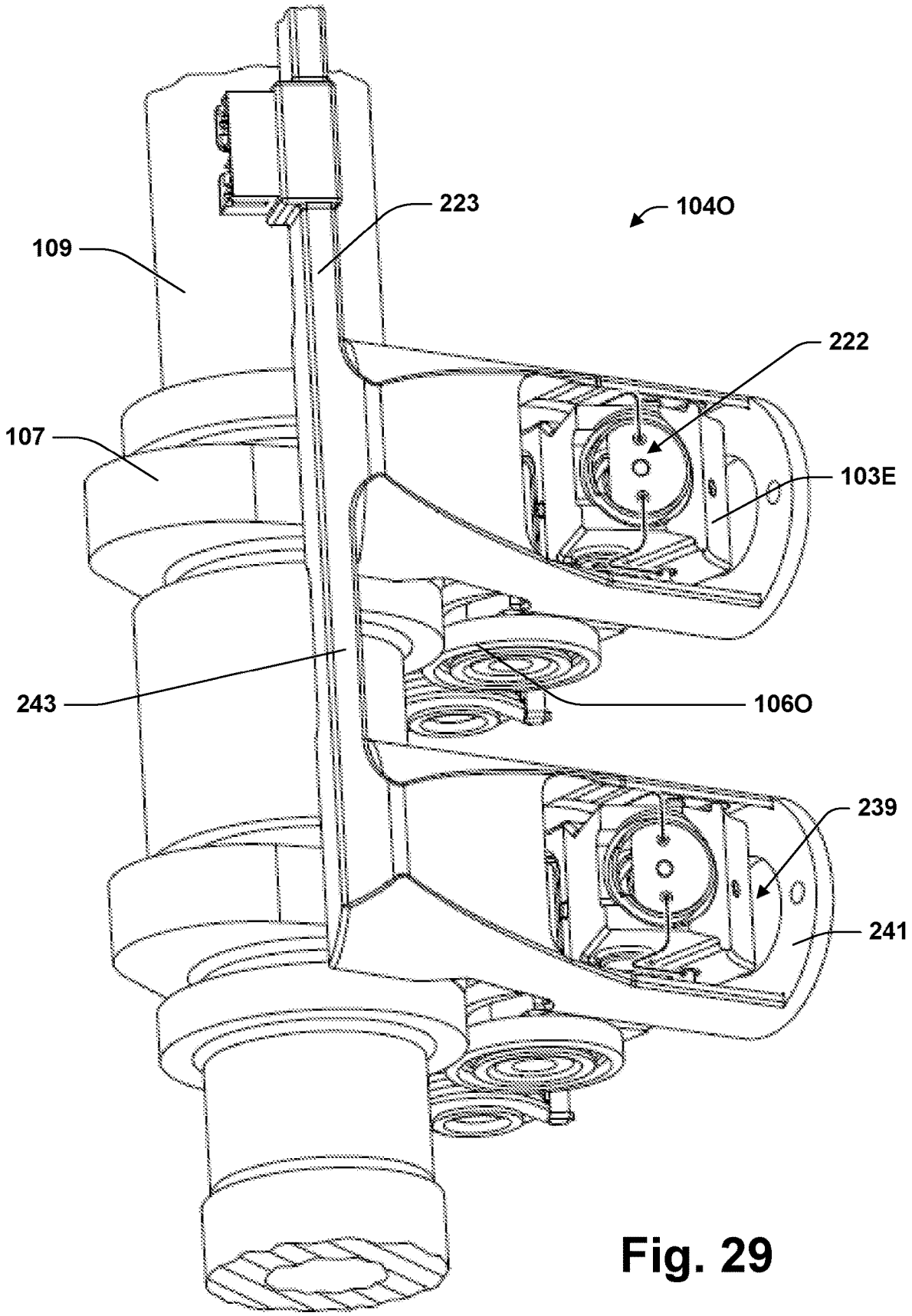
FIG. 29 is another perspective view of the valvetrain of FIG. 26.
Figure 30:
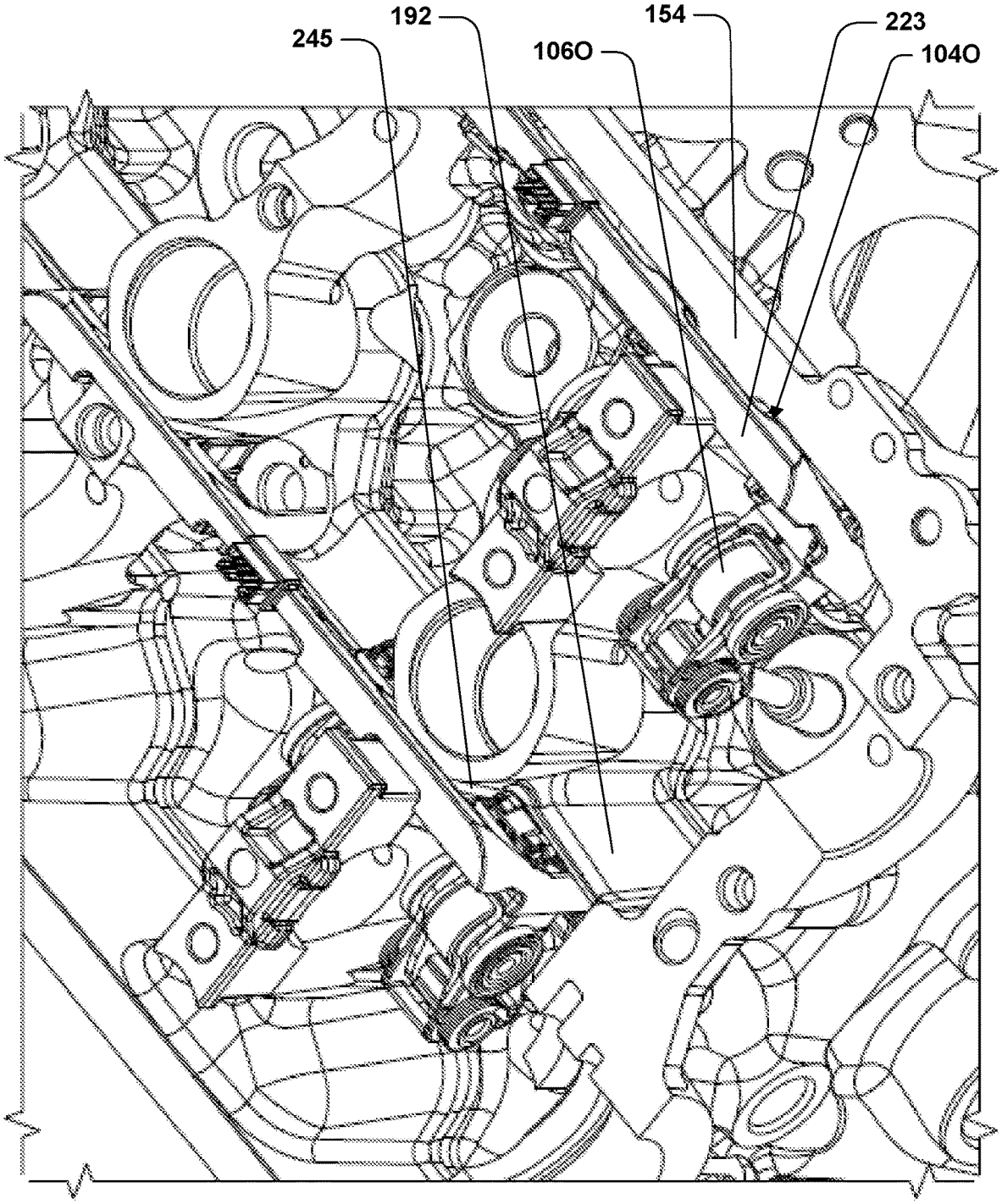
FIG. 30 is perspective view of the valvetrain of FIG. 26 installed in an engine.

FIGS. 26-31 illustrate parts of a valvetrain 104O according to some aspects of the present teachings. FIGS. 26 and 27 provide perspective views of a portion of the valvetrain 104O that includes two rocker arm assemblies 106O, two pivots 140, and a power transfer module 223. A power transfer module, as the term is used in the present disclosure, is a structure that includes an electrical contact and a mounting frame that holds an electrical contact in position adjacent a rocker arm assembly. Power transfer module 223 is shown separately in FIG. 27. A rocker arm assembly 106O is shown separately in FIG. 28. FIG. 30 illustrates parts of valvetrain 104O installed is engine 100. Pivots 140, which may be hydraulic lash adjusters, provide fulcrums for rocker arm assemblies 106O.

Rocker arm assemblies 106O each include two pivotally connected rocker arms 103E and 103F. As shown in FIG. 29, an electromagnetic latch assembly 222 is installed in each outer rocker arm 103E. Electromagnetic latch assembly 222 includes a coil 119 that receives power via contact pins 212, which are mounted to and held one on each side of rocker arm 103E.

Power transfer module 223 includes leaf springs 215. Leaf springs 215 are electrical conductors. Power transfer module 223 is designed to hold leaf springs 215 in abutment with contact pins 212. Electrical connections through which coil 119 may be powered are made between contact pins 212 and leaf springs 215. There may be two electrical connection to each rocker arm 103E, the two connections being made on opposite sides of the rocker arm 103E. Electrical contact may be maintained even as contact pins 212 slide over the surfaces of leaf springs 215 in connection with normal operation of rocker arm assemblies 106O.

Rocker arm assemblies 106O are configured to undergo a pivoting motion as they are actuated by cams 107 (see FIG. 29). This pivoting occurs approximately on an axis. In some of these teachings, contact pins 212 are located proximate that axis to keep the relative motions between contact pins 212 and leaf springs 215 small. The range of motion cams 107 induce on contact pins 212 may be 10% or less the range of motion cams 107 induce on parts of rocker arm assemblies 106O most distant from the axis. In some of these teachings, the range of motion for contact pins 212 is 2% or less the motion induced on the parts of rocker arm assemblies 106O most distant from the axis.

On the other hand, in some of these teachings, a certain range of motion between contact pins 212 and leaf springs 215 is desirable. A portion of the surface of a leaf spring 215 may be coated with a material that significantly increases the resistance of an electrical circuit comprising a connection between contact pin 211 and leaf spring 215. Contact pin 211 may move to that high resistance surface only when cam 107 is lifting rocker arm 103E. The increase in resistance may be detected and used to provide rocker arm position information, which in turn may be used in diagnostic or control operations.

As can be seen in FIG. 27, leaf springs 215 have an outwardly bowed portion 221 adapted to flex against a contact pin 211. Power transfer module 223 may be adapted to maintain the bow 221. These adaptations may include structures that hold leaf spring 215 above and below the bowed portion 221. In some of these teachings, power transfer module 223 is over-molded around leaf spring 215, wherein the over-molding secures leaf spring 215 to power transfer module 223.

A connection plug 219 may be positioned at the top of power transfer module 223. Connection plug 219 may be used to couple power transfer module 223 to a vehicle's electrical system. An elevated location such as this, which may be above the heights of rocker arm assemblies 106O, facilitates the coupling with the vehicle's electrical system in that wires connecting to connection plug 219 have a short distance to travel before passing through the valve cover (not shown). The wires may pass through the valve cover adjacent a spark plug tower. One option is to run the wires into and out of a spark plug tower in order that they pass through the valve cover within a spark plug tower.

Power transfer module 223 has a lower portion 241 that rests against cylinder head 154 adjacent a pivot 140 and an upper portion 243 that fits over and may rest on a raised portion 245 of cylinder head 154. Raised portion 245 may be above rocker arm assembly 106. "Above" is used in the sense that rocker arm assembly 106O is "above" a combustion chamber formed within cylinder head 154. Power transfer module 223 has openings 239 that fit around pivots 140. Openings 239 abut pivots 140 and help locate power transfer module 223. Openings 239 may fit tightly around pivots 140, whereby pivots 140 may by joined to power transfer module 223 prior to installation. Openings 233 may be formed in lower portion 241 of power transfer module 223 and used to bolt power transfer module 223 to cylinder head 154.

Figure 31:
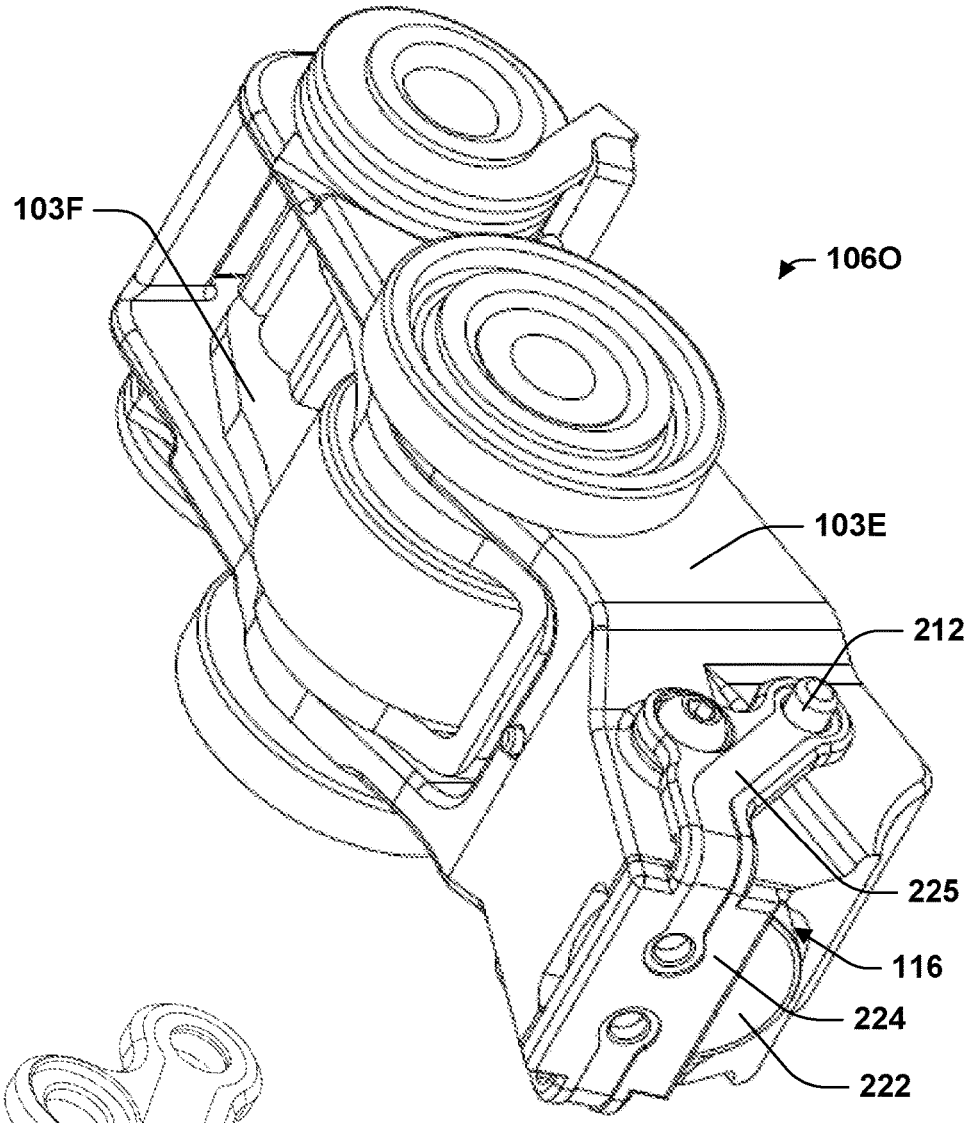
FIG. 31 is a perspective view of the rocker arm assembly of FIG. 28 fit with a contact frame.
Figure 32:
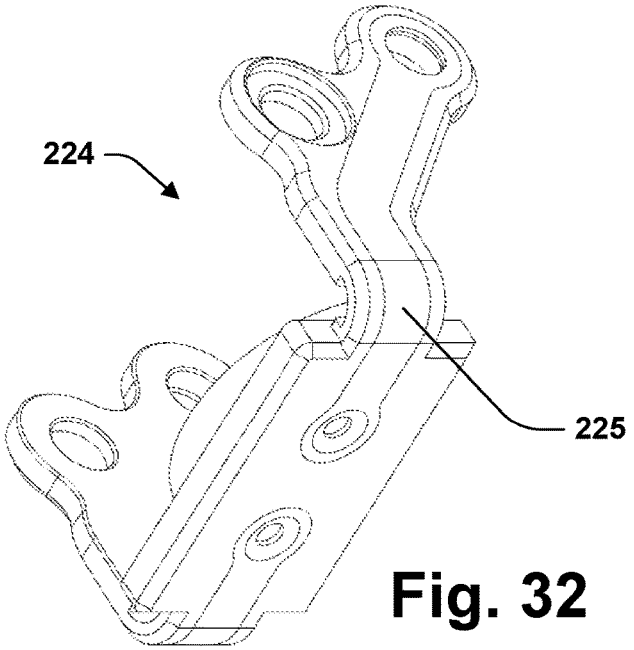
FIG. 32 is a perspective view of the contact frame of FIG. 31.

FIG. 31 shows rocker arm 106B together with a contact frame 224 that supports contact pins 212 and electrical connections between coil 119 and contact pins 212. The electrical connections are preferably made with stamped metal leads 225. Leads 225 may be joined to contact pins 212 at one end and coil ties off pins at the other. Stamped metal leads 225 may be press fit around or soldered to the pins.

Contact frame 224 may be press fit with an opening 226 through which electromagnetic latch assembly 222 is installed within rocker arm 103E. Contact frame 224 may also be held to the sides of rocker arm 103E. In this example, contact frame 224 is bolted to the sides of rocker arm 103E. Alternatively, support at the sides of rocker arm 103E may be provided by piloting contact pins 212 to the sides of rocker arm 103E. Insulation may prevent short circuiting between a contact pin 212 and rocker arm 103E although this structure without insulation could be used to form a connection to ground.

Figure 33:
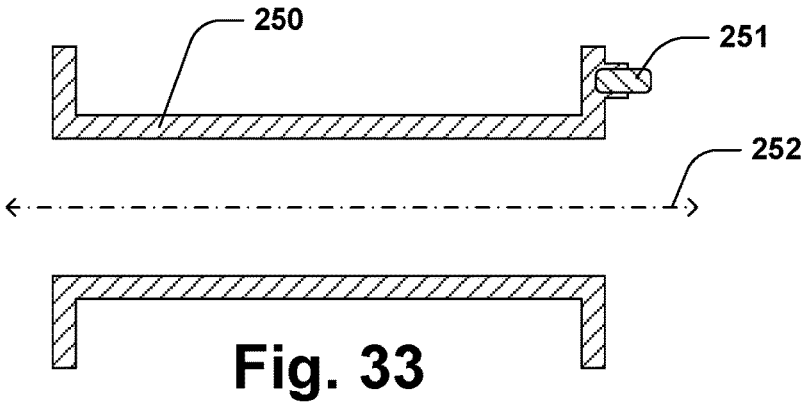
FIG. 33 illustrates a cross-sectional side view of a bobbin according to some aspects of the present teachings.
Figure 34:
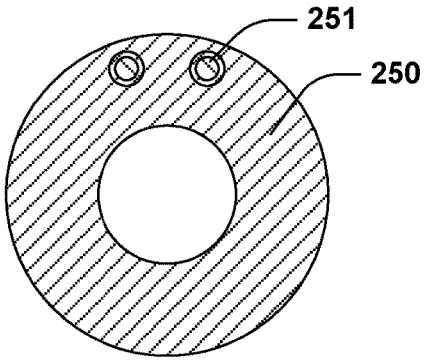
FIG. 34 illustrates an end view of the bobbin of FIG. 33.

FIGS. 33 and 34 illustrate a bobbin 250 for electromagnetic latch assembly 222. Coil 119 may be wound about bobbin 250, whereby the axis 252 of bobbin 250 becomes the axis of coil 119 and latch pin 115. Bobbin 250 provides tie-offs that interface the ends of coil 119 with tie-off pins 251. The tie-offs and tie-off pins 251 are located above axis 252. With reference to FIG. 39, some of the rocker arm assemblies 106E may be installed with their back ends very near a side wall of cylinder head 154. These rocker arm assemblies 106O tilt away from the side wall. There is more room between tie-off pins 251 and the nearest sidewall if bobbin 250 holds tie-off pins 251 above axis 252.

Figure 35:
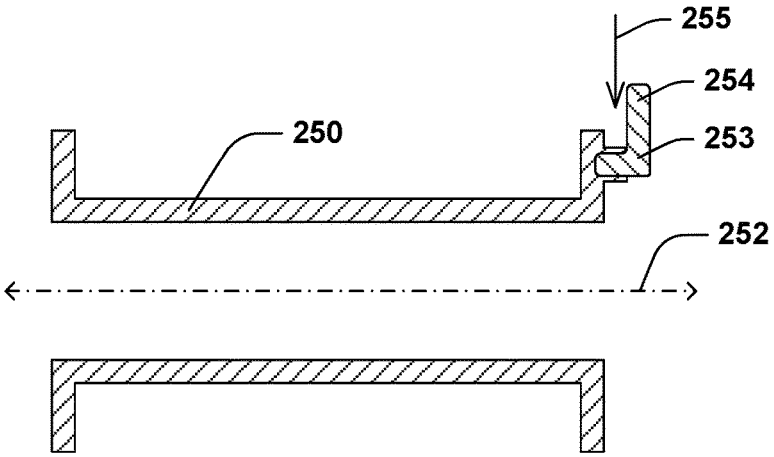
FIG. 35 illustrates the bobbin of FIG. 33 with an alternate tie-off pin according to some aspects of the present teachings.

FIG. 35 illustrates bobbin 251 with tie-off pins 253, which further facilitate installing electromagnetic latch assembly 222 on cylinder head 154. Tie-off pins 253 project outward from bobbin 250 such that a portion 254 of tie-off pins 253 will be located outside the back end of rocker arm 103E after electromagnetic latch assembly 222 has been installed within rocker arm 103E. Outside rocker arm 103E, portions 254 of coil tie-offs 254 project away from axis 252. Optionally, portions 254 project above rocker arm 103E where they may be coupled to a contact frame 224. To facilitate assembly, a can cap (not shown) may be slid vertically between bobbin 250 and portions 254 as indicated by the arrow 255 prior to bobbin 250 being inserted into a coil can.

The components and features of the present disclosure have been shown and/or described in terms of certain teachings and examples. While a particular component or feature, or a broad or narrow formulation of that component or feature, may have been described in relation to only some aspects of the present teachings or some examples, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, comprising:

an electromagnetic latch assembly comprising a magnet and a latch pin translatable between a first position and a second position; and a rocker arm assembly comprising a rocker arm that forms a chamber that houses the magnet and a cam follower configured to engage a cam mounted on a camshaft as the camshaft rotates.

2. A valvetrain according to claim 1, wherein:

one of the first and second latch pin positions provides a configuration in which the rocker arm assembly is operative to actuate the moveable valve in response to rotation of the cam shaft to produce a first valve lift profile; and the other of the first and second latch pin positions provides a configuration in which the rocker arm assembly is operative to actuate the moveable valve in response to rotation of the cam shaft to produce a second valve lift profile, which is distinct from the first valve lift profile, or the moveable valve is deactivated.

3. A valvetrain according to claim 1, wherein the chamber is a retrofit hydraulic chamber.

4. A valvetrain according to claim 1, wherein the magnet is a coil that provides an electromagnet for the electromagnetic latch assembly.

5. A valvetrain according to claim 4, further comprising:
a shell surrounding the coil and having an opening through which the latch pin extends;
wherein the latch pin has a non-circular profile where it passes through the opening; and
the shape of the opening cooperates with the latch pin profile to restrict rotation of the latch pin.

6. A valvetrain according to claim 5, wherein:
the coil is operative to generate magnetic flux;
an operative portion of the magnet flux generated by the coil passes through the shell.

7. A valvetrain according to claim 4, wherein:
the rocker arm has a first end out of which the latch pin extends, a second end opposite the first end, and a side between the first and second ends; and
a circuit powering the coil includes conductors that run from the coil, out the second end of the rocker arm, and from there to the side of the rocker arm; and
the circuit includes an electrical connection made at the side of the rocker arm.

8. A valvetrain according to claim 7, wherein one of the conductors runs along the side of the rocker arm and is held by a contact frame that is supported within an opening in the second end of the rocker arm.

9. A valvetrain according to claim 8, wherein the contact frame is also supported by a fitting against the side of the rocker arm.

10. A valvetrain according to claim 9, wherein the fitting is, or is an extension of, a contact pin that forms part of the circuit.

11. A valvetrain according to claim 7, wherein:
the rocker arm has an upper side on which the cam follower engages the cam;
the coil has an axis and is wound about a bobbin providing tie-offs for the conductors; and
ends of the conductors are held by the tie-offs at locations that are displaced to the upper side relative to the location of the coil axis.

12. A valvetrain according to claim 4, wherein:
the rocker arm has a first end out of which the latch pin extends, a second end opposite the first end, and a side between the first and second ends;
the coil has an axis and comprises a wire wound about a bobbin with tie-off pins to which ends of the wire are attached; and
a portion of each tie-off pin emerges from the rocker arm at the second end of the rocker arm and extends away from the coil axis.

13. A method of manufacturing a valvetrain according to claim 12, comprising:
winding the wire around the bobbin to form a coil with the ends of the wire attached to the tie-off pins;
placing one side of a can cap on an end of the bobbin with the tie-off pins on an opposite side of the can cap;
sliding the coil, with the can cap attached, into a can; and
installing the can with the coil inside in the chamber formed by the rocker arm;
wherein the tie-off pins extend away from the axis.

14. An internal combustion engine, comprising:
a valvetrain according to claim 4; and
circuitry operable to energize the coil with a current in either a first direction or a second direction, which is opposite the first direction.

15. A valvetrain according to claim 4, wherein the electromagnetic latch assembly provides the latch pin with positional stability independently from the coil when the latch pin is in the first position and when the latch pin is in the second position.

16. A valvetrain according to claim 15, wherein the magnet is a permanent magnet.

17. A valvetrain according to claim 16, wherein the permanent magnet is held stationary with respect to the rocker arm.

18. A valvetrain according to claim 17, wherein the permanent magnet contributes to the positional stability of the latch pin both when the latch pin is in the first position and when the latch pin is in the second position.

19. A valvetrain according to claim 18, wherein:
the permanent magnet is within the coil; and
the coil is also housed within the chamber.

20. A valvetrain according to claim 18, wherein:
the electromagnetic latch assembly forms a first magnetic circuit and a second magnetic circuit that is distinct from the first magnetic circuit;
the permanent magnet produces magnetic flux;
an operative portion of the magnetic flux from the permanent magnet follows the first magnetic circuit when the latch pin is in the first position; and
an operative portion of the magnetic flux from the permanent magnet follows the second magnetic circuit when the latch pin is in the second position.

21. A valvetrain according to claim 20, wherein:
the coil encircles a volume within which a portion of the latch pin comprising low coercivity ferromagnetic material translates;
the electromagnetic latch assembly comprises one or more sections of low coercivity ferromagnetic material outside coil;
both the first and the second magnetic circuits include the portion of the latch pin formed of low coercivity ferromagnetic material;
the second magnetic circuit passes around the coil via the one or more sections of low coercivity ferromagnetic material; and
the first magnetic circuit does not pass around the coil.

22. A valvetrain according to claim 20, wherein:
the electromagnetic latch assembly further comprises a second permanent housed within the chamber and held stationary with respect to the rocker arm; and
the second permanent magnet also contributes to the positional stability of the latch pin both when the latch pin is in the first position and when the latch pin is in the second position.

23. A valvetrain according to claim 22, wherein the permanent magnet and the second permanent magnet are arranged with confronting polarities.

24. A valvetrain according to claim 23, wherein the permanent magnet and the second permanent magnet are separated by a pole piece mounted between them.

25. A valvetrain according to claim 24, wherein:
the permanent magnet, the second permanent magnet, and the pole piece are arranged about an opening through which the latch pin translates;
the permanent magnet, the second permanent magnet, and the pole piece bound the opening; and
the pole piece bounds the opening more narrowly than the permanent and the second permanent magnet.

* * * * *